US008519906B2

(12) United States Patent
Richards et al.

(10) Patent No.: US 8,519,906 B2
(45) Date of Patent: Aug. 27, 2013

(54) LOCATING SYSTEM

(75) Inventors: Anthony Richards, Borehamwood (GB); Andrew Ackland, Bitterne (GB); Stephen Braithwaite, Highfield (GB)

(73) Assignee: Loc8tor Ltd., Borehamwood ( * ) Notice: Subject to any disclaimer, the term of this patent is extended or adjusted under 35 U.S.C. 154(b) by 219 days.

(21) Appl. No.: 12/743,361

(22) PCT Filed: Nov. 17, 2008

(86) PCT No.: PCT/IB2008/003861

§ 371 (c)(1), (2), (4) Date: Sep. 30, 2010

(87) PCT Pub. No.: WO2009/101471

PCT Pub. Date: Aug. 20, 2009

(65) Prior Publication Data

US 2011/0012775 A1 Jan. 20, 2011

Related U.S. Application Data

(60) Provisional application No. 60/988,393, filed on Nov. 15, 2007, provisional application No. 60/988,384, filed on Nov. 15, 2007.

(51) Int. Cl.
*H01Q 15/14* (2006.01)

(52) U.S. Cl.
USPC ..... 343/912; 343/894; 343/718

(58) Field of Classification Search
USPC ..... 343/912, 894, 718, 700 MS, 792.5
See application file for complete search history.

(56) References Cited

U.S. PATENT DOCUMENTS

| | | | | |
|---|---|---|---|---|
| 5,913,549 | A * | 6/1999 | Skladany | 29/600 |
| 2003/0034887 | A1 * | 2/2003 | Crabtree et al. | 340/539 |
| 2005/0200557 | A1 * | 9/2005 | Tanaka et al. | 343/904 |
| 2006/0109191 | A1 * | 5/2006 | Shtrom et al. | 343/795 |

* cited by examiner

*Primary Examiner* — Douglas W Owens
*Assistant Examiner* — Collin Dawkins
(74) *Attorney, Agent, or Firm* — Michael A. Scaturro

(57) ABSTRACT

The invention provides an antenna capable of performance similar to a Yagi-Uda antenna. However, unlike a conventional Yagi Uda antenna, the antenna of the invention is implementable on a substrate and thereby provides a directional antenna capable of disposition within a slender housing such as a cellular communications device. One embodiment of the invention provides an antenna comprising a substrate including a ground plane. The ground plane comprises a base portion and a spine portion extending from the base portion along a central axis of the substrate. A driven antenna element is disposed on a portion of the substrate and coupled to the spine portion to form a first antenna dipole. At least one antenna director element is disposed on a portion of the substrate and coupled to the spine portion to form a second antenna dipole. A reflector element comprises a portion of the ground plane.

15 Claims, 17 Drawing Sheets

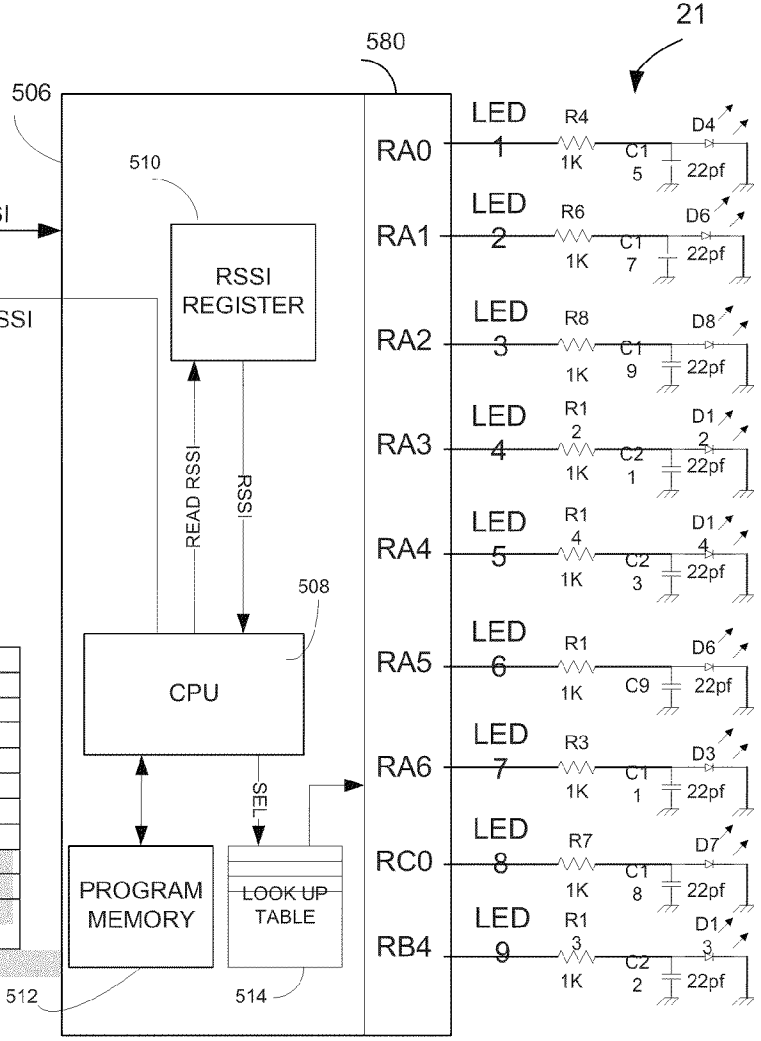
FIG. 5
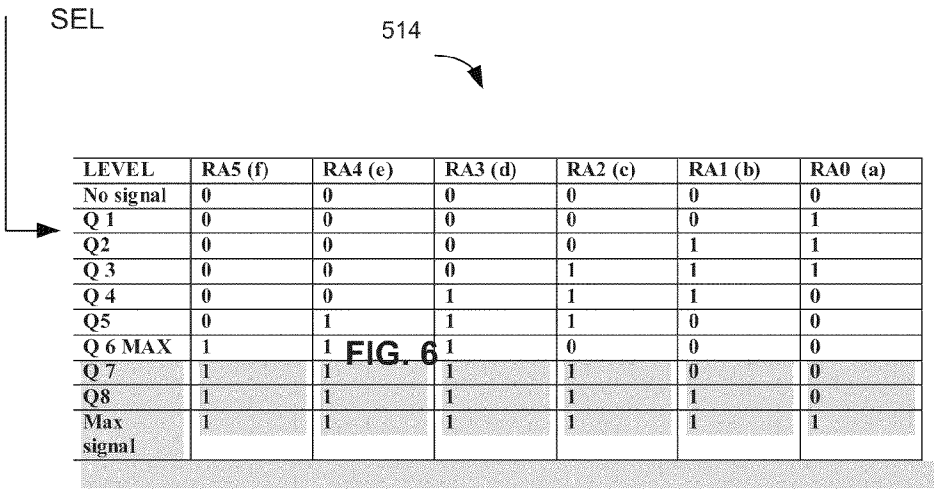
| LEVEL | RA5 (f) | RA4 (e) | RA3 (d) | RA2 (c) | RA1 (b) | RA0 (a) |
|---|---|---|---|---|---|---|
| No signal | 0 | 0 | 0 | 0 | 0 | 0 |
| Q 1 | 0 | 0 | 0 | 0 | 0 | 1 |
| Q2 | 0 | 0 | 0 | 0 | 1 | 1 |
| Q 3 | 0 | 0 | 0 | 1 | 1 | 1 |
| Q 4 | 0 | 0 | 1 | 1 | 1 | 0 |
| Q5 | 0 | 1 | 1 | 1 | 0 | 0 |
| Q 6 MAX | 1 | 1 | 1 | 0 | 0 | 0 |
| Q 7 | 1 | 1 | 1 | 1 | 0 | 0 |
| Q8 | 1 | 1 | 1 | 1 | 1 | 0 |
| Max signal | 1 | 1 | 1 | 1 | 1 | 1 |
FIG. 6
FIG. 6

LOCATING SYSTEM

CROSS REFERENCE TO RELATED APPLICATIONS

This application is a United States national phase entry of PCT/IB2008/003861 and a continuation-in-part of U.S. application Ser. No. 11/205,608 filed Aug. 17, 2005 in the United States (now abandoned). This application claims priority to provisional application Ser. Nos. 60/988,384 and 60/988,394 each filed Nov. 15, 2007 and incorporated herein in entirety by reference.

FIELD OF THE INVENTION

The present invention relates to a system for use in locating (e.g., monitoring position of) an object, e.g., a missing object.

BACKGROUND OF THE INVENTION

The present invention relates to a system for use in locating (e.g., monitoring position of) an object, e.g., a missing object.

Portable wireless locator systems for assisting in the location of missing articles (e.g., valuables such as keys and the like) are well known in the art. U.S. 2003/0034887 (Crabtree et al) discloses one such system. However, the wireless locator systems available on the market typically suffer from one or more of: a short range, a large physical size (both tag and locator device), a short battery-life and no directional capabilities. Accordingly, the present applicant has appreciated the need for an improved locator system which overcomes or at least alleviates the problems associated with the prior art.

BRIEF SUMMARY OF THE INVENTION

In accordance with a first aspect of the present invention, there is provided a system for use in locating an object, comprising: a transceiver device for placing with an object to be located, the transceiver device comprising a first radio frequency communication module; and a locator device comprising: a second radio frequency communication module for communicating with the transceiver device; distance determining means for estimating separation between the transceiver device and the locator device based on a status signal received from the transceiver device; and alarm means for alerting a user when separation between the transceiver device and the locator device falls below a predetermined distance.

In this way, a system is provided for warning a user when an object (e.g., article, person or animal) associated with a transceiver device (hereinafter "tag") enters within a predetermined range of the locator device. Advantageously, such a system may be employed as an aid for managing assets (e.g., in the workplace).

The tag may be configured to transmit a status signal in response to an activation signal received from the locator device. In one embodiment, the tag is configured to transmit a plurality of status signals (i.e., intermittently) in response to receipt of an activation signal. In this way, the tag may be configured to repeatedly transmit status signals whilst the tag is outside the predetermined distance.

DESCRIPTION OF THE DRAWING FIGURES

These and other objects, features and advantages of the invention will be apparent from a consideration of the following detailed description of the invention considered in conjunction with the drawing figures, in which:

FIG. 5 is a block diagram of a display portion of a locator device according to an embodiment of the invention;

FIG. 6 illustrates a look up table implementing the display portion of a locator device according to an embodiment of the invention;

DETAILED DESCRIPTION OF THE INVENTION

Figure 1:
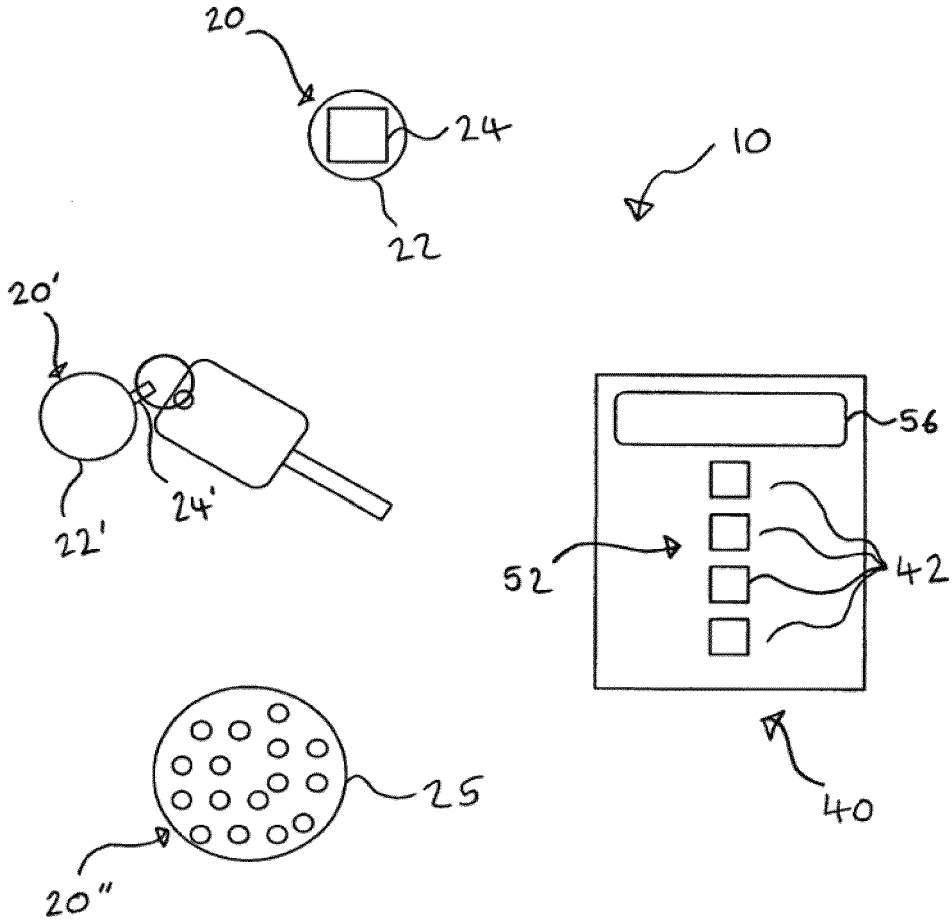
FIG. 1 is schematic representation of a system according to an embodiment of the present invention.

In accordance with a first aspect of the present invention, there is provided a system for use in locating an object, comprising: a transceiver device for placing with an object to be located, the transceiver device comprising a first radio frequency communication module; and a locator device comprising: a second radio frequency communication module for communicating with the transceiver device; distance determining means for estimating separation between the transceiver device and the locator device based on a status signal received from the transceiver device; and alarm means for alerting a user when separation between the transceiver device and the locator device falls below a predetermined distance.

In this way, a system is provided for warning a user when an object (e.g., article, person or animal) associated with a transceiver device (hereinafter "tag") enters within a predetermined range of the locator device. Advantageously, such a system may be employed as an aid for managing assets (e.g., in the workplace).

The tag may be configured to transmit a status signal in response to an activation signal received from the locator device. In one embodiment, the tag is configured to transmit a plurality of status signals (i.e., intermittently) in response to receipt of an activation signal. In this way, the tag may be configured to repeatedly transmit status signals whilst the tag is outside the predetermined distance.

The distance determining means may comprise a signal strength meter for measuring strength of status signals received from the tag. Since in normal use signal strength is generally assumed to be indicative of distance traveled by a radio frequency signal, separation between the tag and the locator device may be indirectly measured in this way. Accordingly, the alarm means may be configured to indicate when signal strength rises above a predetermined level.

The system may comprise one or more further tags as previously defined. For example, the system may comprise a total of up to 24 tags. In this way, the locator device may be used in locating a plurality of objects. Each tag may have a unique identification code associated therewith. In this way, the locator device may be configured to identify the identity of a tag activating the alarm means. For example, each tag may be configured to transmit a status signal which includes its own unique identification code. In one embodiment, the alarm means is configured to identify the specific tag causing the alarm. For example, the alarm means may comprise a visual display for displaying an alphanumeric identifier (e.g., tag number or name).

The unique identification codes of the tags may be stored in the locator device and the locator device may be configured to allow a user to select one or more tags to be located. The locator device may be configured to selectively address one or more of the tags. For example, the locator device may transmit an activation signal which includes the identification code of the selected tag. Upon receipt of the activation signal, a tag will compare the identification code contained in the transmitted activation signal with an identification code stored therein. If the two codes correspond, the tag will transmit a status signal.

The activation signal may comprise a message packet including a tag identifier for identifying which of the plurality of tags is to be activated. In one embodiment, each tag is assigned a different bit in the tag identifier. For example, in a message packet having a tag identifier that is three bytes in length, up to 24 tags may be represented by the 24 available bits. In this way, up to 24 tags may be activated upon transmission of a single activation signal.

The locator device may also have an identification code associated therewith. Accordingly, the message packet may further comprise a locator device identifier. In one embodiment, the message packet may be reconfigurable to allow at least a portion of the locator device identifier to represent further tags. For example, in a message packet having a locator device identifier that is three bytes in length, one of the three bytes may be re-designated as an additional tag identifier. In this way, 6144 (i.e., 24.times.256) tags, for example, may be uniquely identified. In addition, a part of the locator device identifier may be re-designated to identify a group of tags. In this way, a group of tags may be readily selected for locating.

In accordance with a second aspect of the present invention there is provided a system for use in locating an object, comprising: a transceiver device for placing with an object to be located, the transceiver device comprising a first radio frequency communication module; and a locator device comprising: a second radio frequency communication module for communicating with the transceiver device; distance determining means for estimating separation between the transceiver device and the locator device using a status signal received from the transceiver device; and an output for providing information based on the estimated separation between the transceiver device and the locator device provided by the distance determining means.

In this way, a system is provided for use in locating (e.g., finding or monitoring position of) an object (e.g., article, person or animal) using a radio frequency (R.F.) communication system.

In one embodiment, the transceiver device and the locator device are configured to communicate with each another using a wireless specification based on IEEE 802.15.4. In this way, improved range capability and reduced power consumption may be advantageously achieved.

The transceiver device and locator device may be configured to distinguish between signals sent from the other respective device and signals sent from a device which is not part of the system. For example, the transceiver device and the locator device may each comprise IEEE 802.15.4-compliant components with their respective medium access control (MAC) settings configured to use a non-standard synchronization codeword.

The IEEE 802.15.4 standard uses spread spectrum techniques at a 2.4 GHz transmission frequency. The bit rate is 250 kb/s. This allows small amounts of data to be transmitted in a short time. In light of the low power consumption of IEEE 802.15.4-compliant devices, the transceiver device may be powered by a battery of modest dimensions.

The distance determining means may comprise a signal strength meter for measuring strength of status signals received from the transceiver device (hereinafter "tag"). Since in normal use signal strength is generally assumed to be indicative of distance traveled by a radio frequency signal, separation between the tag and the locator device may be indirectly measured in this way.

In a first mode (hereinafter the "locate mode"), the output may be configured to provide an indication of the separation between the tag and the locator device. In this way, the system may operate to assist a user in locating a missing object.

In the locate mode, the output may be configured to display a visual indication of the estimated separation. For example, the output may comprise a Liquid Crystal display (LCD) screen for displaying a graphic indicative of approximate distance (e.g., a bar of variable height or length). In another form, the output may comprise one or more lights for indicating distance. For example, the output may comprise a plurality of lights, whereby the number of lights or the color of lights illuminated is configured to be indicative of approximate distance. In addition, or instead, the output may comprise sound-generating means for providing an audio signal indicative of separation.

The locator device may further comprise a directional aerial. For example, the locator device may comprise an aerial defining an axis, the aerial being configured to receive a status signal from the tag at maximum strength when the axis is substantially aligned with the tag and a weaker signal when not so aligned. In this way, a user may obtain an indication of a direction or bearing of the tag (e.g., by sweeping the locator device around in a circle and finding the direction of strongest signal). The directional aerial may comprise a multiple-element Yagi array antenna. The directional antenna may have directional gain of substantially 8 dB.

In the locate mode, the tag may be configured to transmit a status signal in response to receipt of an activation signal from the locator device. The locator device may be configured to transmit a plurality of activation signals at a predetermined rate for the duration for which the input commands the communication module to transmit activation signals. In another embodiment, the transceiver device may be configured to transmit a series of reply signals in response to receipt of an activation signal. For example, the tag may continue to transmit reply signals until receipt of a subsequent signal from the locator device or until a predetermined period of time has elapsed.

In another mode (hereinafter the "alert mode"), the output may be configured to raise an alarm when the estimated separation between the tag and the locator device exceeds a predetermined distance. In this way, the system may operate to warn a user when a tag is leaving a predetermined range.

The tag may be configured to transmit a status signal in response to an activation signal received from the locator device. In one embodiment, the tag is configured to transmit a plurality of status signals (i.e., intermittently) in response to receipt of an activation signal. In this way, the tag may be configured to repeatedly transmit status signals whilst the tag is within the predetermined distance.

In embodiments where the distance determining means comprises a signal strength meter, the output raises an alarm when signal strength falls below a predetermined level.

In alert mode, the output may be configured to activate a further operation. For example, the output may activate a security device (e.g., a CCTV camera or the like). In this way, the alert mode may be used as a part of a security system for protecting valuables.

In yet another mode (hereinafter the "asset management mode"), the output may be configured to indicate when the estimated separation between the tag and the locator device falls below a predetermined distance. In this way, the system may operate to warn a user when a tag enters within a predetermined range of the locator device.

The tag may be configured to transmit a status signal in response to an activation signal received from the locator device. In one embodiment, the tag is configured to transmit a plurality of status signals (i.e., intermittently) in response to receipt of an activation signal. In this way, the tag may be configured to repeatedly transmit status signals whilst the tag is outside the predetermined distance.

In embodiments where the distance determining means comprises a signal strength meter, the output raises an alarm when signal strength rises above a predetermined level.

In yet another mode (hereinafter the "idle mode"), the tag is configured to switch intermittently between an inactive mode, in which the first radio frequency communication module is unresponsive to incoming signals, and an active mode, in which the first radio frequency communication module is responsive to incoming signals. In this way, the power consumed by the tag may be minimized during periods of inactivity.

In order to ensure that signals sent by the locator device are received by the tag, the duration of signals sent by the locator device to the tag when in idle mode should be longer than the length of inactive mode.

The system may be configured to operate in one or more of the modes hereinbefore defined. In the case of a system configured to operate in one of a plurality of modes, the locator device may include a selector for switching between modes. In the case of the idle mode, the tag may be placed in this mode automatically after completion of another mode.

The system may comprise one or more further tags as previously defined. For example, the system may comprise a total of up to 24 tags. In this way, the locator device may be used in locating a plurality of objects. Each tag may have a unique identification code associated therewith. In this way, the locator device may be configured to identify the identity of a tag being located (e.g., location monitored in alert mode). For example, each tag may be configured to transmit a status signal which includes its own unique identification code. In one embodiment, the alarm means is configured to identify the specific tag causing the alarm. For example, the output may comprise a visual display for displaying an alphanumeric identifier (e.g., tag number).

The unique identification codes of the tags may be stored in the locator device and the locator device may be configured to allow a user to select one or more tags to be located. The locator device may be configured to selectively address one of the devices. For example, the locator device may transmit an activation signal which includes the identification code of the selected tag. Upon receipt of the activation signal, a tag will compare the identification code contained in the transmitted activation signal with an identification code stored therein. If the two codes correspond, the tag will transit a status signal in accordance with a selected mode of operation.

The activation signal may comprise a message packet including a tag identifier for identifying which of the plurality of tags is to be activated. In one embodiment, each tag is assigned a different bit in the tag identifier. For example, in a message packet having a tag identifier that is three bytes in length, up to 24 tags may be represented by the 24 available bits. In this way, up to 24 tags may be activated upon transmission of a single activation signal.

In use, a system comprising one or more further tags may be configured such that the location of one tag may be monitored in one mode whilst another tag is monitored in a different mode. However, alert mode may suspended when locate mode is activated. In this way, a user is able to concentrate on the task of locating an object without the distraction of alarms being set off by the alert or asset management modes.

FIG. 1

In the embodiment illustrated, transceiver device 20 comprises a casing 22 comprising an adhesive layer 24 for attachment to an everyday article (e.g., wallet or the like). transceiver device 20' takes the form of a key-ring accessory 22' comprising attachment means 24' having an aperture for receiving a key-ring. transceiver device 20" is configured to be integrally mounted within a golf ball 25 during manufacture. Each transceiver device 20, 20' and 20" has its own unique identification code associated therewith to allow the locator device 40 to locate one or more specific tag. The locator device 40 may be a portable device, e.g., a handset. In one form, the locator device 40 may be incorporated in a hand-held device such a Personal Digital Assistant (P.D.A.), an electronic organizer, an MP3 player, mobile telephone or the like.

FIG. 2

Figure 2:
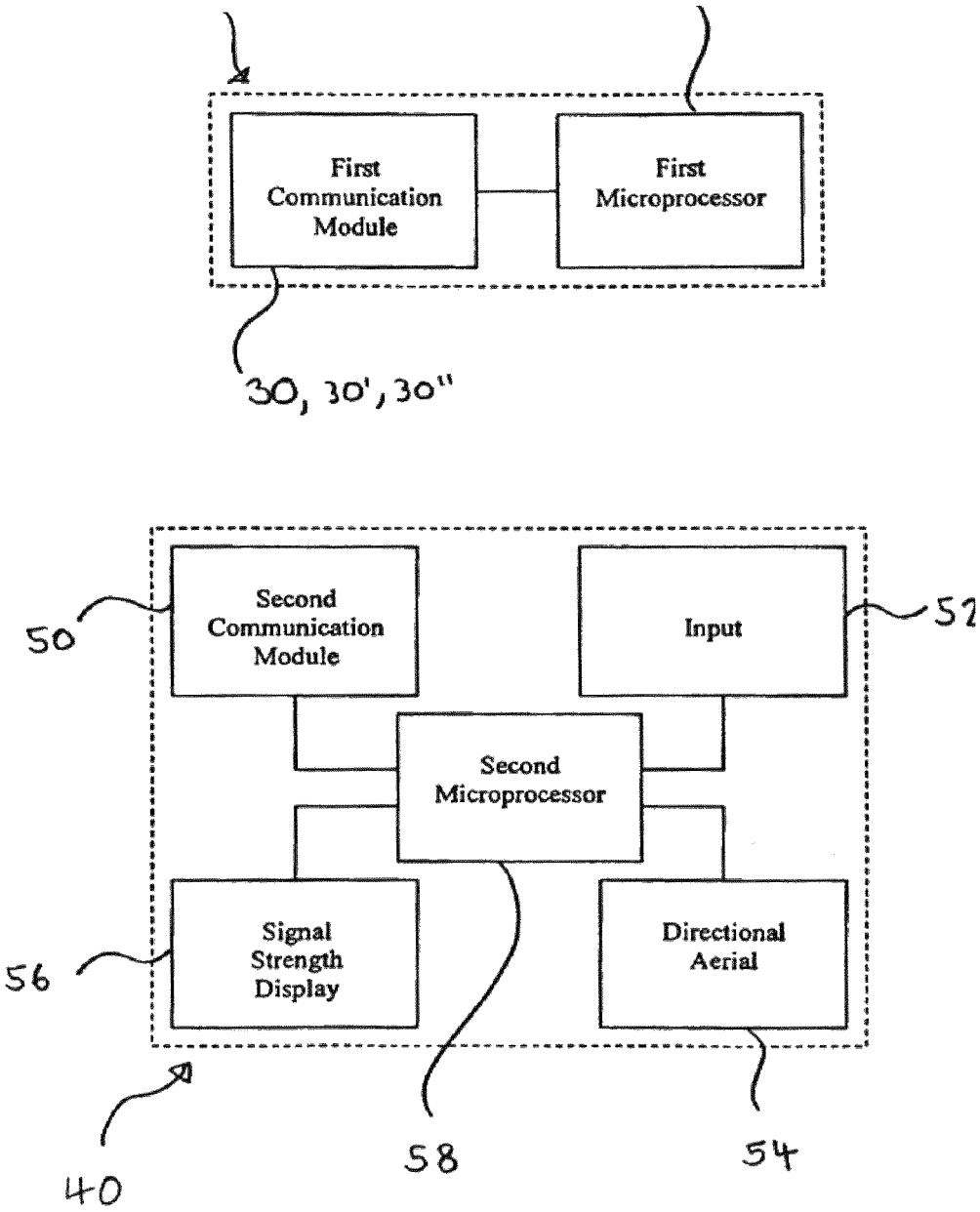
FIG. 2 is a schematic representation of the component parts of the system of FIG. 1 according to an embodiment of the invention.

Transceiver devices 20, 20' and 20" each comprise a first R.F. communication module 30, 30' and 30" and a first processor 32, 32' and 30" (depicted as a single unit in FIG. 2 only for the sake of brevity).

The locator device 40 comprises a second R.F. communication module 50 which includes an omni-directional aerial, an input 52 (in the form of buttons or keys 42 shown in FIG. 1 which may include Braille markings), a directional aerial 54 and an output 56 all linked to a second microprocessor 58 which includes distance determining means. Output 56 includes an LCD including a graphic representative of signal strength and alarm means configured to produce an audio and/or visual alarm. Additional audiovisual aids (not shown) may be provided on both the locator device and tags to aid locating tagged objects. For example, each tag may be configured to emit a unique tone.

For optimum high range capability and low power-consumption, the first and second communication modules preferably operate using a specification based on the IEEE 802.15.4 standard. The IEEE 802.15.4 standard uses spread spectrum techniques at 2.4 GHz transmission frequency. The bit rate is 250 kb/s which allows small amounts of data to be transmitted in a short time. In light of the low power consumption of IEEE 802.15.4-compliant devices, the transceiver device may be powered by a battery of modest dimensions.

Using a specification based on the IEEE 802.15.4 standard, the first and second communication modules may have a maximum range of between 100 m and 200 m. For example, the first and second communication modules may have a maximum range of between 125 m and 175 m. However, it is conceivable that other suitable protocols (e.g., ZigBee™ or Bluetooth) may be used to implement the present invention.

Modes of operation of the system 10 and details of the structure of message packets transmitted between the locator device 40 and tags 20, 20', 20" are described in detail below.

Summary of Modes

The locator device 40 is configured to operate in a plurality of modes, namely: "idle mode," "locate mode," "alert mode," "asset management mode" and "treasure hunt mode." Locate mode is used to give audio and/or visual feedback to the user about the position of an object (e.g., missing object), thereby helping to direct the user to the object. Alert mode alerts the user when an object travels beyond a set allowed perimeter. In asset management mode, the locator device maintains a fixed position, and tags that come within a certain distance set off an alarm. In treasure hunt mode (which is functionally identical to asset management mode) it is the user who moves around with the locator device and an alarm is sounded if a tag comes within a certain range of the locator device. Idle mode is the state in which tags reside when they are not being communicated with or used to find items, so as to save battery life. The five modes, and the way they operate will now be discussed in more depth.

Message Packets

Most message packets for the system exchanged between locator device and tags will follow the same message structure, and an example structure is shown. TABLE-US-00001 Byte 1 2 3 4 5 6 7 Description Message ID Tag number 3 byte handheld ID number.

One byte is required to carry the message identifier, describing what the rest of the data in the packet refers to. The other 6 bytes of the packet are data, and this is split down into two sections. The first section is the 3-byte tag number. The second that is also 3-bytes long carries information about the locator device ID number.

In the system there are a maximum of 24 tags that belong to any one locator device, and this information is incorporated into the tag number field of the message packet. By using three bytes for this field, one bit can be assigned to each device. This allows downstream transmissions from locator device to tag to address more than one tag, whereas upstream transmissions from tag to locator device will only show the tag number that sent the message.

Tag Wake-Up

Tags that are not currently in an active (for example Locate) mode reside in idle mode. In idle mode, the tag polls the air interface every few seconds to determine if the locator device is communicating with it. If the tag finds the air interface in use, then it wakes up. This polling period is called the tag wake-up interval. The wake-up interval is designed to minimize battery consumption by switching off parts of the tag when they are not needed.

The wake-up period must be catered for in the locator device system design. Every transmission from locator device to a tag in idle mode must be longer than the tag wake-up interval to ensure that the tag wakes up.

Tag Registration

The registration process is invoked by the locator device. The locator device sends a continuous stream of 'register request' messages to the tag for a period in excess of the tag wake-up interval. When the tag wakes up and receives one or more such messages, it will either respond unconditionally if it is unregistered, or will respond if the identity of the originating locator device matches that already programmed into the tag (or a master locator device ID).

If the tag is unregistered or recognizes the locator device ID in the 'register request' message, it sends an accept request back to the locator device. The message is repeated frequently, so that once the locator device ceases its repeated transmission, it will receive the acknowledgement.

If the locator device receives a valid acknowledgement from a single tag, the locator device sends the 'register' message to the tag containing the registration number. This register message carries the unique ID for the locator device, which is then stored in the tag. It also carries the assigned tag number, by which the locator device recognizes the tag. The tag then responds finally with a registration result (success or failure), which results in an audiovisual response to the user.

All the messages during the message registration handshake must be of high signal strength to ensure that the separation between locator device and tag is between a minimum distance and a maximum distance. Only units separated by this range should reply to registration messages. However, tags up to twice the maximum distance from the locator device may respond to the requests, due to variations in RF performance.

A time delay is incorporated between the locator device accepting the registration acknowledgement message from the tag, and sending the registration data. If two or more tags accept the request, the locator device cancels the registration process to stop two tags getting the same registration data. If only one tag accepts the request during the delay time, the registration process is completed.

A tag can only be registered to one locator device at a time, so pre-registered tags need to be unregistered by the parent locator device (with matching ID), or a master locator device (with specific foreign ID) before they can be re-registered. The tag initially comes unregistered, and must be registered before use. The registration data (ID & tag number) are stored on the tag in non-volatile memory so that when batteries are changed, the registration data is not lost. When tags are unregistered by the locator device, data is set back to the factory default.

A total of 24 tags may be registered to one locator device, using all of the tag addressing slots in the message packet. The non-volatile memory on the locator device is used to store a name for each of the 24 tags, to assist the user in associating particular tags to assigned functions.

Locate Mode

A locate mode is provided to help the user to locate a specific tag. The user initiates the "locate mode" on the locator device, and the tag listens for locate messages. The locator device will transmit the locate message continuously at first, and then with gaps, to allow the locator device to receive responses from the tag to the locate message. A tag initially in idle mode will enter locate mode upon receiving a valid locate message from the locator device, causing the tag to continually transmit locate messages to the locator device at a constant rate.

A tag in alert mode switches to locate mode when it receives a locate message from the locator device. The locator device then responds every time a reply is received with another locate message to keep the tag in locate mode. A tag will stay in locate mode whilst receiving the constant locate messages from the locator device, or otherwise time out after a set period. The locator device will stay in locate mode until a timeout is reached, or the user ceases to locate, switches tag or changes mode. At this point, the tag is brought from locate mode into idle mode with the transmission of an idle message.

If the user stops locating the current tag, the locator device sends the idle message, however if the user switches tag then the new locate message to another tag is inferred as an idle message to the previous tag.

Tags in locate mode alert the user with audiovisual emissions. These both occur between 0.5 and 2 times per second.

Example Locate Message Structure

The locate message from locator device to tag will have a message ID stating that it is a 'locate' message. The locator device ID will take the value of the locator device's unique ID number that is registered with a tag, and the tag number will take the value of the tag to put into locate mode. This locate message starts locate mode, and starts the operation described in the locate mode section.

The tag then responds with messages with a 'hello' message ID. This contains the same data as the initial locate message, so that the locator device knows that the message is bound for it, and so that it knows its tag number. It uses the hello message as described in the locate mode section, to determine the position of the object. There may be three factory settings in alert mode/asset management mode: "near," "medium," and "far." Users may be able to alter sensitivity of the factory settings, for example to make "near" very close to "medium." Factoring "far" may be set at 75% of maximum; a user could change the setting to, for example, 99%.

Alert Mode

Alert mode is provided to tell the user when a tag moves outside a maximum configurable distance. The mechanism for detecting this condition is to monitor the received power of messages sent from tag to locator device, and infer the distance from the received power. There are three different configurable distances to the user in alert mode.

Alert mode is initiated by the locator device, for any subset of the tags belonging to that locator device. This subset forms an 'alert list'. If the locator device leaves alert mode, the alert list is remembered for when the mode is re-entered. When the user initiates alert mode, the locator device issues message waking tags from idle mode and places them in alert mode. If there are no tags on the alert list, the locator device maintains radio silence, and awaits information from the user about which tags to put onto the alert list and into alert mode.

A tag in idle or locate mode is switched to alert mode if a valid alert message is received. A tag in alert mode sends messages periodically to the locator device so that the distance can be calculated between the tag and the locator device. The tag continues to transmit until the locator device tells the tag to leave alert mode, and return to idle mode or enter another mode. When in alert mode, the tag does not give out any audiovisual signals, however when entering alert mode a short audiovisual signal is given.

The locator device unit remains in alert mode until the user intervenes. When in alert mode it processes the tag responses. If the locator device receives any message from any tag not on the alert list, a message is used to make that tag enter idle mode.

The locator device alerts the user when a tag goes past a distance threshold, or if (for example) two or more messages fail to reach the locator device. If the condition that made the locator device alert the user is cleared, then the alert is cleared. Any tag in the alert condition is added to the 'alarm list', and, when alarm list is not empty, an alarm condition is given to the user. The alarm condition causes an audiovisual output on the locator device, with a timeout and interactive options for the user to pursue. The locator device also has a timeout to check if alert mode has been active for a long period of time. The alert mode alarm may include an audio and/or visual output and/or a vibrating element.

Example Alert Message Structure

The alert message from the locator device to tag has a unique message ID telling the tag(s) that it is an alert message. This causes the tag(s) to enter alert mode that are indicated in tag number bit field and that are registered to the locator device ID field.

In alert mode the tags periodically send a message with ID of 'hello' to the locator device, the same ID used in locate mode. The ID field is filled with the locator device's ID, and the tag number of the tag responding. This is used as described in the alert mode section to determine the distance between tag and locator device.

Asset Management

Asset management mode provides a user with a proximity warning, to raise an alarm when assets (objects that have been tagged) come within a certain range of the locator device. Treasure hunt mode similarly raises an alarm when tagged objects come within a certain range of the locator device, however in treasure hunt mode, the locator device is assumed to be mobile, rather than the tags. The combined mode is abbreviated to Treasure Hunt and Asset Management (THAM). THAM comes in (for example) two variants, (for example) THAM-24 and THAM-256, and have different message structures for the two variants.

In a similar fashion to alert mode, the received message power on a message transmitted from tag to locator device is analysed to calculate the distance between tag and locator device.

Treasure Hunt 256 Mode

To use asset management and treasure hunt 256 mode "THAM-256," the system must be set up to use a different ID structure to the normal 3-byte ID structure. The first of the three bytes is set to the unique foreign ID. The user enters a second "THAM group" number into the locator device, which is used as an ID between locator device and tags. The third byte called the "THAM subgroup" is individually assigned to each tag, as is the tag number. These numbers can then be used to register tags. TABLE-US-00002 Byte 1 2 3 4 5 6 7 Description Message Tag number Foreign THAM THAM ID ID group subgroup.

An unlocking function is envisaged to allow the locator device to enter this THAM-256 mode, and change the ID structure. Only an unlocked locator device can register a tag as foreign, and only a locator device with the same THAM number, or a master locator device, can re-register the tag later.

Once the locator device has been given the foreign ID and THAM group number, and it has registered tags, it can be used in either THAM mode. The locator device issues a message to make all tag(s) with the same THAM group number enter alert mode, and the tags in this group respond periodically with a reply signal. When a tag comes within a user specified distance of the locator device, an audiovisual alert is given. In asset management mode this will occur because the tag has moved too close to the locator device, and in treasure hunt mode because the locator device has moved close to the tag. The locator device will then display the THAM subgroup number, and the tag number, so that the tag is uniquely identified.

In asset management mode, it is envisaged that there will not be two tags with the same THAM subgroup number and tag number, so that (for example) 24*256=6144 devices can be uniquely identified. In treasure hunt mode, the tag number could be used to signify different values of treasure that have been found, and the THAM subgroup number is used to identify the (name of the) treasure.

As in alert mode, there are (for example) three configurable distances at which the tag can be identified as being close to the locator device. It is envisaged that THAM-256 mode can work alongside Alert mode (using foreign ID's), alerting if the object is too close or too far. It would however be suspended in Locate mode. Due to the fact that the locator device has a foreign ID, the standard 3-byte ID locate and alert mode are no longer accessible. Other tags with standard 3-byte ID's in alert mode will be left unaffected, and the locator device will ignore their alerts.

The locator device may also be able to take the THAM group number of a tag that it heard broadcasting the alert signal.

256 Mode Message Structure

An alert message is sent from the locator device containing the foreign ID and THAM group number. Any foreign registered tag(s) that match the THAM group number enter alert mode. The tag(s) in alert mode then periodically send a 'hello' message back to the locator device with foreign ID, THAM group number, THAM subgroup number and tag number. The locator device uses the responses as described in the THAM section to determine distance between tag and locator device.

Treasure Hunt 24 Mode

THAM 24 reverts back to the original 3-byte unique device ID. The locator device with registered tags signals the tags to enter alert mode. As all the tag(s) will have the same unique 3-byte ID, the 3-byte tag number is used to choose which tag(s) enter alert mode. The locator device then monitors the responses from tags, using the received power to calculate the distance between tag and locator device. When a tag comes within the range specified by a setting on the locator device, the locator device gives an audiovisual response and displays the tag number.

24 Mode Message Structure

The alert message is given from locator device to tag(s), using the unique 3-byte ID. The tag numbers in the message are used to specify which tag(s) are to enter alert mode. The tags then enter alert mode, sending a message with ID 'hello' periodically. The received messages are checked to be valid against the 3-byte ID, and used to determine the distance between tag and locator device. This information is used as described in the Asset Management/Treasure Hunt 24 Mode section.

Panic Button and Messages

A special variant of a normal tag may be fitted with a 'panic' button. The panic function may form a special case of the alert mode. When the tag is in alert mode, and the alert signals being monitored by the locator device, pressing the panic button sends a message with a different ID to the locator device. This causes the locator device to immediately enter an alert condition and put the tag that pressed the panic button onto the alarm list. The message takes the standard packet format, so that the locator device can identify which tag pressed the panic button from the tag field. The tag will also give an audiovisual alert when in panic mode.

The description of locating device configurations, features and functions described above represents example configurations, features and functions suitable for implementing the display or the antenna of the present invention. However, the invention is not limited to implementation in any specific device or device type. The inventive antenna and display enabled by the disclosure herein will find a wide variety of applications and devices suitable for implementation. Further, the display disclosed herein can be implemented independently of the antenna, and vice versa.

FIG. 3

Figure 3:
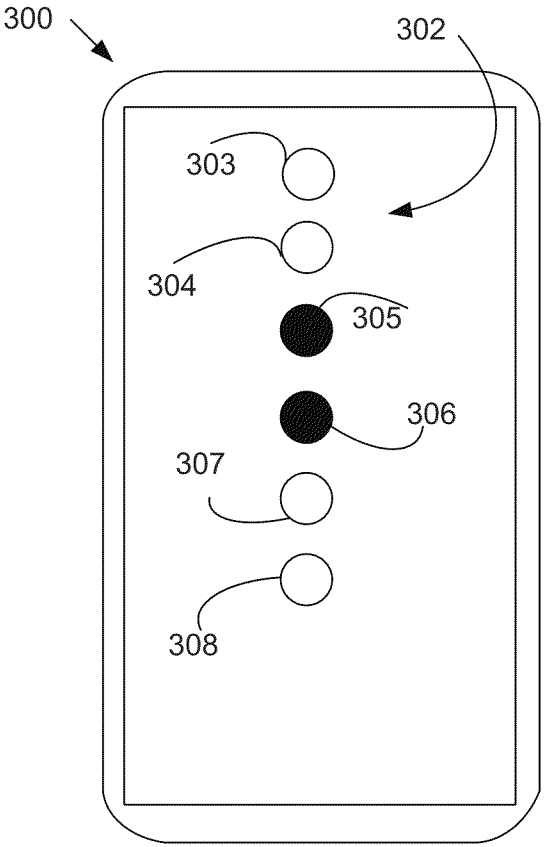
FIG. 3 illustrates a front view of a locator device including a display portion according to an embodiment of the invention.

FIG. 3 illustrates a front view of a locator device 300 including a signal strength indicating display portion 302 according to an embodiment of the invention. In the illustrated embodiment, device 300 is housed in a compact, lightweight, slim profile portable device of a housing type commercially available and employed, e.g., for a conventional "i-Phone™ (Apple Computers™). However, unlike any conventional device, device 300 implements an embodiment of the novel display disclosed herein. A series of light emitting devices (303, 304, 305, 306, 307, 308) indicate distance, with respect to device 300, of an object to be located. Various patterns of illuminated and non illuminated light emitting devices correspond to distance of the object to be located with respect to device 300, as is explained in greater detail below.

FIG. 4

RF identification (RFID) devices, and many other types of locating devices, such as the locating device described above with reference to FIG. 3, rely on directional antennas to locate objects. The antennas used in such handheld locating devices present special design challenges. First, the locating devices themselves are ideally lightweight and portable. Second they are ideally capable of efficient and low cost manufacture. While conventional directional antennas may perform well in free space applications, their size limits their application to larger devices. There remains a need for an antenna that can meet desired antenna performance specifications while fitting within a small lightweight hand-held device such as that illustrated in FIGS. 3 and 4. What are needed are antennas for use in Radio Frequency Identification RFID devices, locating devices, and a wide range of radio frequency (RF) applications that would benefit from an antenna with the characteristics achieved by the antenna of the invention, yet capable of housing in a compact, lightweight and portable device. Such antennas are desirable in applications that are directional, powerful, efficient and highly reliable antennas, yet sufficiently compact for housing in a hand held device. Further, antennas of embodiments of the invention provide such performance in a compact device while accommodating other circuit components for the radio frequency device, and other applications, such as communication within the same housing.

Figure 4:
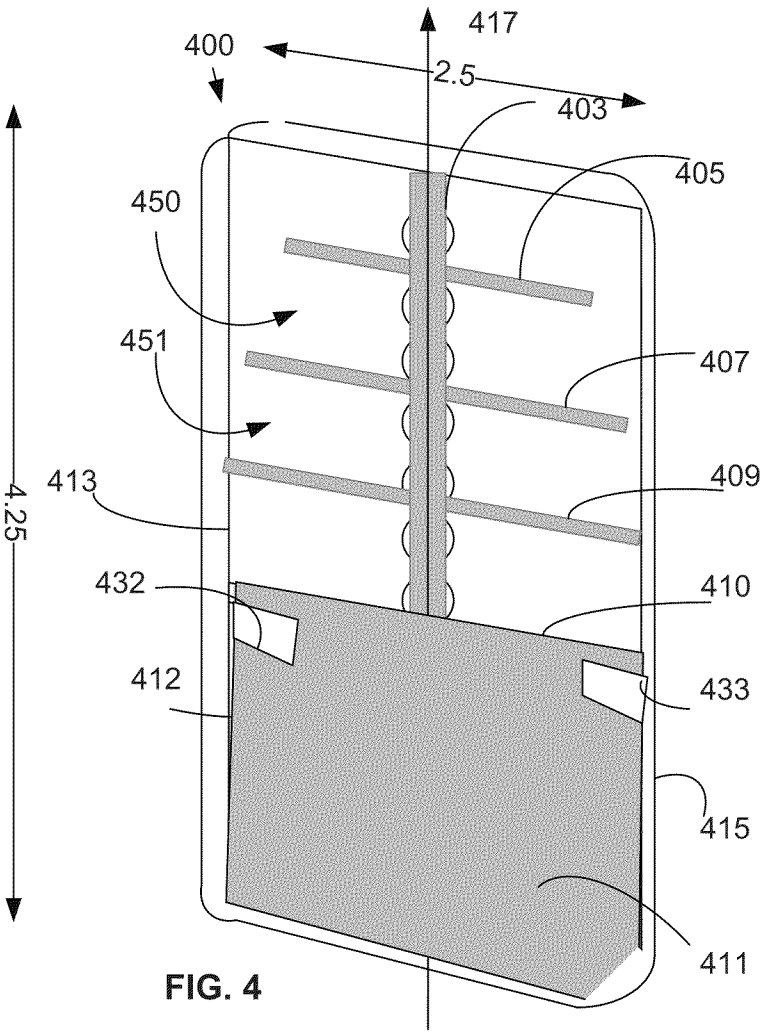
FIG. 4 illustrates a rear view of a locator device including an antenna portion according to an embodiment of the invention.

FIG. 4 illustrates a rear perspective view of a device 400 such as the device illustrated in FIG. 3, according to an embodiment of the invention. The device 400 of FIG. 4 includes a housing 415 defined by a front housing portion (best illustrated in FIG. 3) and a rear housing portion 451. Enclosed within housing 415 is an antenna 450 supported by a substrate 413 according to an embodiment of the invention. An example of a suitable substrate 413 is a printed circuit board (PCB), for example, a multilayered PCB. Substrate 413 includes a ground plane portion 411. Antenna 450 comprises a spine portion 403 having a proximal end portion in contact with ground plane 411. The distal end of spine portion 403 extends along a longitudinal axis, for example axis 417 of substrate 413. Axis 417 also indicates a bore-sight direction for antenna 450 in the direction of the arrow.

Antenna 450 further comprises a director element 405 coupled to spine portion 403 to comprise a first dipole of antenna 450. Antenna 450 further comprises a first driven element 407 and a second driven element 409 coupled to spine portion 403 to form second and third dipoles comprising antenna 450. A reflector element 410 of antenna 450 comprises a portion of ground plane 411. In one embodiment of the invention reflector element 410 is defined by a first cut-out portion 432 and a second cut out portion 433 of ground plane 411.

Antenna 450 is supported by substrate 413 and disposed within housing 415. In one embodiment of the invention, a plurality of display elements a-f (such as those illustrated in FIG. 3) are electrically coupled at one end to ground plane 411 via spine portion 403 of antenna 450. In that manner the invention provides a compact lightweight directional antenna 450 configured for disposition within housing 415 while providing power, efficiency and reliability for a broad range of RF identification applications. Further, antenna 450 advantageously enables ancillary electronic circuits to be housed within the same compact device housing 415 as the antenna 450.

Further details of the design and construction of various embodiments of antenna 420 are provided below in connection with FIGS. 10-20.

FIG. 5

FIG. 5 is a block diagram of a portion of a locator device, comprising a hand held receiver 500 and employing a display device according to an embodiment of the invention. In one embodiment of the invention, an antenna 450 (illustrated in FIG. 4) is housed within device 500 and configured to receive radio frequency (RF) signals. Device 500 is configured for displaying received signals on a display 21 comprising, e.g., light emitting display elements 1-9, according to an embodiment of the invention. As described above, to locate an object, the locator device provides an interrogation signal. In one example embodiment, all RF tags within the range of the interrogation signal respond to the interrogation signal and provide a signal containing the identification of the responding RF tag (e.g., a tag attached to an object to be located) to the handheld transceiver 500. To implement this functionality, the locator device 500 includes a transceiver 502 which may be implemented as an RF "front end" integrated circuit (RFIC) coupled to an LED interface module 506 which is in turn coupled to a plurality of LEDs (LED 1-LED 7) for displaying RF tag response signals to the interrogation signal of the locator device. These elements are described as follows.

Transceiver 500 may be implemented using commercial off the shelf components known as radio frequency integrated circuits RFIC, such as, for example, the TI CC2420, manufactured by Texas Instruments or the AT86RF230, manufactured by Atmel. Transceiver 500 preferably includes receiver circuitry (not shown) and an RSSI (Received Signal Strength Indicator) module 504 for measuring the signal strength of RSSI values received at transceiver 502.

Transceiver 502 communicates with the LED interface module 506 via an SPI interface 506. The SPI interface may be implemented as any standard Serial Peripheral Interface (SPI) port. The SPI interface specification is available from Motorola, Inc., or from any device manufacture incorporating the SPI interface in their products. The SPI interface specification is hereby incorporated herein for all purposes. In some embodiments, it is contemplated to implement the SPI interface using off the shelf Chipcon PICs such as, for example, the Chipcon PIC16F886) or the Atmel mega series.

LED interface module 506 includes CPU 508, RSSI Register 510, program memory 512 and look-up table 514. CPU 508 controls the operations associated with displaying the received RSSI values on the LED display. In some embodiments, CPU 508 may be implemented as an application specific integrated circuit (ASIC) or programmed into one or more field programmable gate arrays (FPGAs). RSSI Register 510 buffers the RSSI values received from RSSI module 504.

Executable code for driving the LEDS of the display typically resides in the program memory 512, and is uploaded to the processor (CPU 508) for execution with RSSI values received from the RSSI register 510. The operations associated with driving the display 21 with received signals may be carried out by execution of program code in the form of software, firmware, or microcode operating on micro-controller 42, which can be of any type. Additionally, code for implementing such operations may be in the form of one or more computer instructions in any form (e.g. source code, object code, interpreted code, etc.) stored in or carried by any computer or machine readable medium.

Operation

In one embodiment, RSSI information is received as part of the response signal from the RF tags in response to interrogation signals issued from the locator device. The RSSI information is typically the voltage of the signal that has been received, amplified and converted into an integer number by an ADC. The RSSI information, transmitted from the RF tags as part of the response signal, are received at transceiver block 502 via antenna 501. Transceiver 502 down-converts the received signals to an intermediate frequency, filters the down-converted signals and digitizes the filtered signal at a prescribed sampling data rate. The down-converted, filtered and digitized values are stored in one or more registers in the RSSI module 504. The stored values are subsequently read by the RSSI register 510 of the LED interface module 506. In some embodiments, it is required to scale the stored values and it may also be required in certain embodiments to apply an offset, depending upon the way in which the RSSI is stored in the RF IC 40. For example, RSSI could potentially vary from −90 dBM to −10 dBm. Given such a wide range, the values need to be converted to levels suitable for the display 21. In certain embodiments, the RSSI values may be averaged. For example, in one embodiment, RSSI values are averaged over 128 microseconds as a running average and is updated every 4 microseconds. At the upper end of the range, the RSSI module 504 provides capabilities for updating the RSSI values at a rate of up to 500 k times per second.

In a preferred embodiment, the RSSI values are read by the RSSI register 510 at a rate of ten times per second (10×/sec). The RSSI values are read by the RSSI register 510 in response to a control signal "GET RSSI" issued from CPU 508 to read the RSSI values from the one or more registers of the RSSI module 504.

The RSSI values stored in RSSI register 510 are transmitted to CPU 508 in response to a command signal "READ RSSI'. The values are supplied as input to a look-up table 514 to determine the LEDs to be activated. One embodiment that allows this RSSI measurement to be converted to an LED display is using a lookup table 514. Under representative conditions measurements can be made of received RSSI values from 0 m to the furthest range of detection of an RF tag. This sampled data can be compiled into lookup table 514 to define discrete ranges of operation to facilitate the identification of those LED segments to be activated to be derived from a given RSSI measurement. An exemplary implementation of look-up table 514 is shown in FIG. 6 and described as follows.

FIG. 6

FIG. 6 illustrates a look up table 514 according to an embodiment of the invention. Each row of the look up table corresponds to a discrete level of an RSSI signal received from the RSSI register 510 of LED interface module 506, via CPU 508. The RSSI signal is provided on the select "SEL" input line of the look-up table 514 to select a particular row. The first column of look-up table 514 corresponds to the signal level of the RSSI signal applied as input via the SEL input. Each row of the table corresponds to a particular range of RSSI signals. In one embodiment, each row corresponds to fixed range of RSSI signals, whose range is equal to every other row in the table, with the exception of the first row. For example, the first row of the look-up table corresponds to no signal applied, however, each subsequent row corresponds to a range of RSSI signals in the respective equidistant ranges 0-1, 1-2, 2-3 and so on. In other embodiments, particular rows of the look-up table 514 correspond to a wider range of RSSI signals than other rows in the table. For example, in one embodiment, the lower and upper rows of look-up table 514 correspond to a wider range of RSSI values than the intermediate rows. This accounts for the fact that signal power (RSSI signals) operate in accordance with a square-law principle relating signal power to distance, which is non-linear.

Driving the low power (current) LEDs 1-9 of the display can be done directly from the output of the look-up table 514 using the column values as a driver 580 with a current setting resistor. For example, in the case where the RSSI input signal to the look-up table 514 has a value corresponding to the Q3 range, LEDs 1, 2 and 3 are lit and LEDs 3, 4 and 5 are extinguished. See row Q3 of FIG. 6.

FIG. 7

Figure 7:
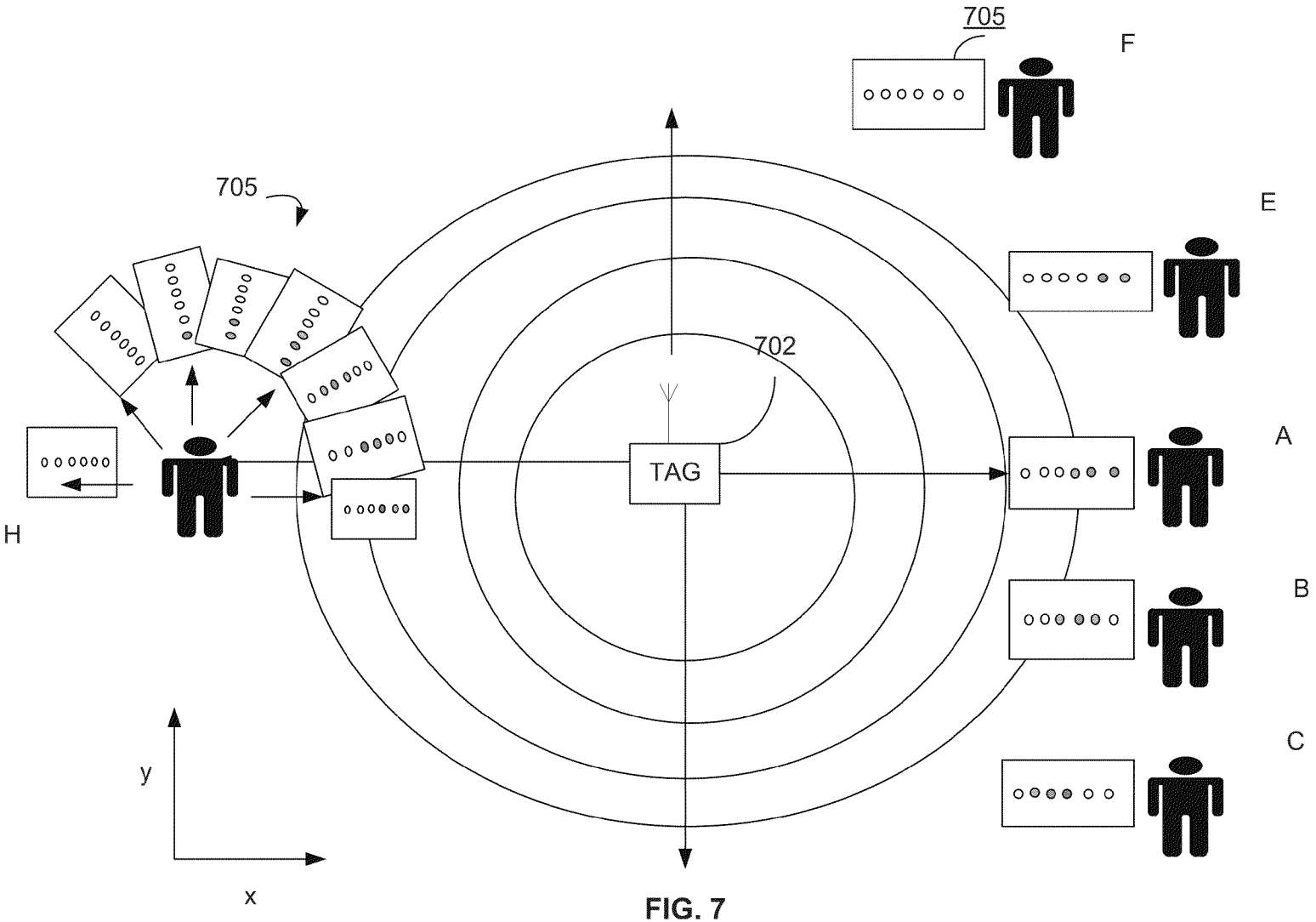
FIG. 7 is a pictorial illustration of operation of a locating device including a display according to an embodiment of the invention.

FIG. 7 is a pictorial illustration of a locator system including a display according to an embodiment of the invention. As shown, a user's orientation with respect to a tag of interest determines the corresponding signal level to be displayed on the user's locator device 705 display. For example, when the user is oriented in a direction directly facing the tag 702, the display of his locator device 705 provides a visual indication of maximum signal strength, i.e., the uppermost three LEDs of the display are lit (see tag position A). Then with increasing angular displacement away from the tag 702, i.e., positions B-H, the LED segments of the display provide a visual indication to the user of a simulated wave of activated LED segments appearing to recede from the uppermost LED segment of the display to the lowest LED segment of the display. In the extreme case where the user is facing in a direction diametrically opposed to the tag 702, i.e., position H, zero segments of the display are activated. It should be appreciated that for the majority of angular positions shown, a multiplicity of LED segments are activated to provide a distinct visual cue to the user.

Thus it can be seen, a display according to an embodiment of the invention provides both angle and distance information. As shown, a user's orientation with respect to a tag of interest determines the corresponding signal level to be displayed on the user's locator device display. For example, when the user is oriented in a direction off-centered from the tag 702, the display of his locator device provides a visual indication of minimal signal strength, i.e., as shown in position F where none of the LED segments are activated. However, as the user walks in the direction shown, e.g., towards A the number of LED segments increase in the display to provide a visual indication to the user of a simulated wave of activated LED segments appearing to move from the lowermost LED segment of the display to the uppermost LED segment of the display. It should be appreciated that the illumination pattern provided by the output of the look up table provides a visual cue to the user indicating relative position of the user to the tag of interest.

FIG. 8

Figure 8:
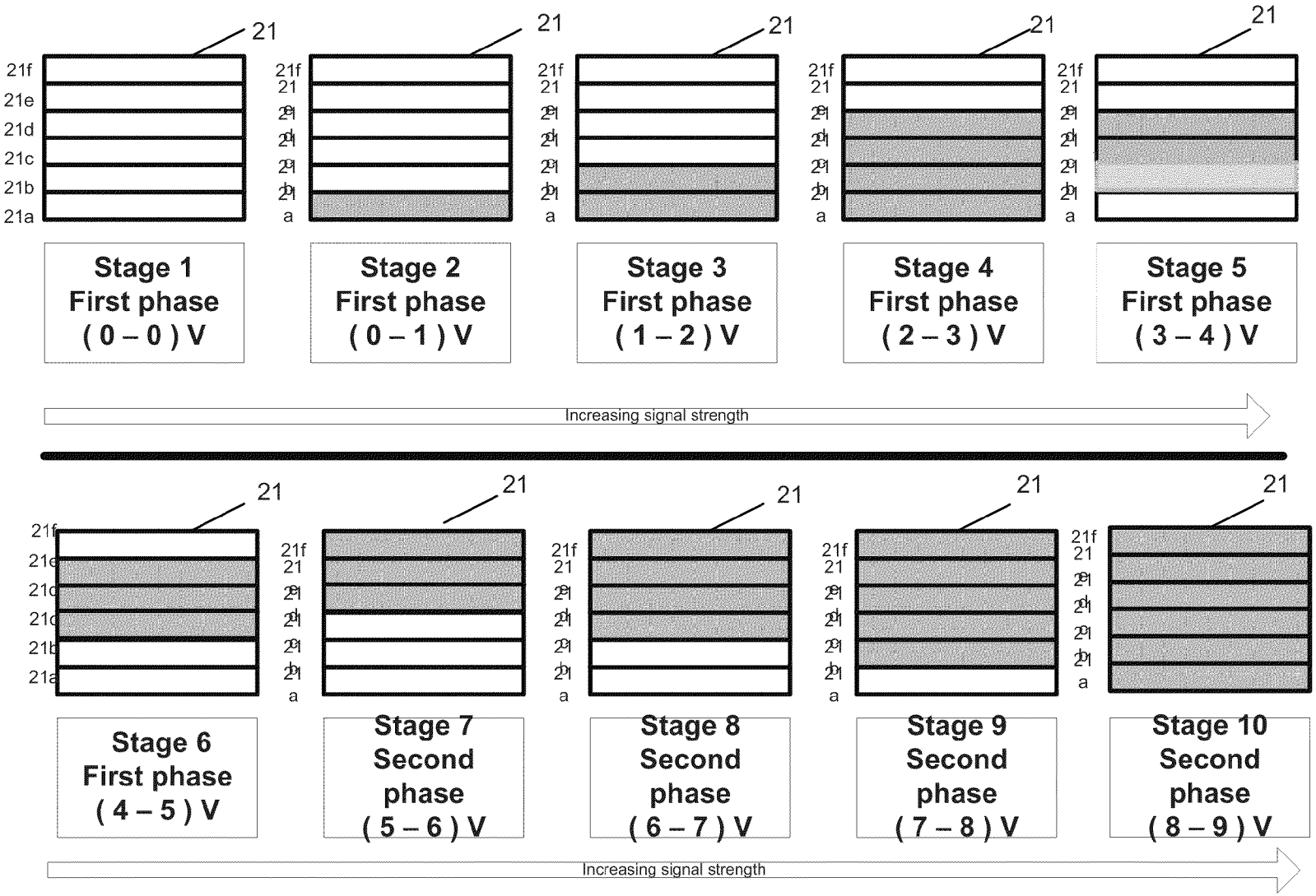
FIG. 8 illustrates illumination of light emitting elements of a display according to an embodiment of the invention.

FIG. 8 illustrates illumination of light emitting elements of a display (21) according to an embodiment of the invention. For ease of explanation and not limitation, a six segment stacked bar-graph display is shown. It is understood, however, that the number of segments (21*a*-21*f*) may be less than or greater than six depending upon the application.

For ease of explanation, the instant example illustrates what may be shown to a viewer of a display 21 when the display 21 is activated in a monotonic sequence (i.e., linearly increasing signal strength).

In accordance with the instant example, input values less than or equal to a RSSI signal strength threshold value of 5 are characterized as having a "low" signal strength value and values above 5 are characterized as having a "high" signal strength value. The "low" signal strength values correspond to a so-called First Phase of the display and the "high" signal strength values correspond to a Second Phase, each phase to be described in greater detail below. It should be understood that a determination of a threshold value separating the First phase (i.e., "low" values of RSSI signal strength) from the Second Phase ("high" values of RSSI signal strength) is arbitrarily determined. It should be understood that the threshold voltage can be any value.

The pre-determined range of 0-5 volts for "low" values of signal strength is divided linearly into 6 stages, illustrated as stage 1 through stage 6, by way of non-limiting example.

First Phase

At stage 1, with no input signal supplied from the look-up table 514 of FIG. 5, none of the LED segments are lit in the LED stack 21*a*-*f*. At stage 2, as the RSSI signal strength value supplied from look-up table 514 continues to grow in magnitude and is determined to be within the range of 0 to 1, a single LED segment is lit in the LED stack, i.e., LED 21*a*. At the next stage 3, as the RSSI signal strength value supplied from look-up table 514 continues to grow in magnitude and is determined to be within the range of 1 to 2, two contiguous LED segments are lit in the LED stack, i.e., LEDs 21*a* and 21*b*. Next, at stage 4, as the RSSI signal strength value supplied from look-up table 514 and is determined to be within the range of 2 to 3, three contiguous LED segments are lit in the LED stack, i.e., LEDs 21*a*, 21*b* and 21*c*. At stage 5, as the signal strength continues to grow in magnitude and is determined to be within the range of 3 to 4, three contiguous LED segments are lit in the LED stack, i.e., LEDs 21*b*, 21*c*, 21*d*. It should be appreciated that at this point, the activated contiguous LED segments at stages 4 and 5, appear to move upward as a single unit or "wave-front" towards the upper boundary of the LED display 21 from stage 4 to stage 5. This unique visual cue of a moving "wave-front" is a key feature of the display of the present disclosure. Next, at stage 6, as the RSSI signal strength value supplied from look-up table 514 continues to grow in magnitude and is determined to be within the range of 4 to 5, three LED segments are activated in the LED stack, i.e., LEDs 21*c*, 21*d*, 21*e*. At this point, it is shown that the so-called "wave-front" of LED segments appears to have moved further upward as a single unit or "wave-front" towards the upper boundary of the LED display 21.

Second Phase

As the signal strength increases above the arbitrarily determined threshold value of 5, the display 21 transitions into a "Second Phase". In this "Second Phase" the wave-front now appears to grow vertically downward from its upper boundary position while maintaining the display state of each LED as the signal strength increases until a point is reached at which all the constituent LED segments of the display 21*a-f* are illuminated (see stage 10).

At stage 7, as the RSSI signal strength value supplied from look-up table 514 continues to grow in magnitude and is determined to be within the range of 5 to 6, three LED segments are lit in the LED stack, i.e., LEDs 21*f*, 21*e*, 21*d*. This stage is a transitional stage which divides the first and second phase. It is referred to as a transitional stage because in succeeding stages the LED segments appear to grow steadily downward as a single unit towards the lower boundary of the LED display 21.

At stage 8, as the RSSI signal strength value supplied from look-up table 514 continues to grow in magnitude and is determined to be within the range of 6 to 7, four LED segments are activated in the LED stack, i.e., LEDs 21*f*, 21*e*, 21*d*, 21*c*. At this point, the LED segments continue to appear to grow steadily downward as a single unit wave-front" towards the lower boundary of the LED display 21.

At stage 9, as the RSSI signal strength value supplied from look-up table 514 continues to grow in magnitude and is determined to be within the range of 7 to 8, five LED segments are activated lit in the LED stack, five LED segments are lit in the LED stack, i.e., LEDs 21*f*, 21*e*, 21*d*, 21*c*, 21*b*. At this point, the LED segments continue to appear to grow steadily downward as a single unit" towards the lower boundary of the LED display 21.

At stage 10, as the RSSI signal strength value supplied from look-up table 514 continues to grow in magnitude and is determined to be within the range of 8 to 9, six LED segments are activated lit in the LED stack, i.e., LEDs 21*f*, 21*e*, 21*d*, 21*c*, 21*b*, 21*a*. At this point, all of the LED segments are activated.

The number of LED segments utilized in the display may be determined, at least in part, by the expected maximum RSSI signal strength. Once this value is known, appropriate range intervals may be determined having defined lower and upper boundaries, i.e., from 0 to the maximum RSSI signal strength. For example, for a maximum signal strength value of 100, 20 range intervals may be chosen, where each range interval corresponds respectively to 0-5, 5-10, 10-15, . . . 90-95, 95-100. This arbitrary division of signal strength values can be fairly represented by a 12 segment display. Alternatively, for a courser range interval of 0-10, 10-20, 20-30 . . . 90-100, comprising a total of 10 ranges, a better design choice is a six segment display as shown in FIG. 8. A general relationship between the number of stages and the expected maximum RSSI signal strength is 1.66 to 1. For example, 10 stages to 6 segments or 20 stages to 12 segments. However, it should be understood that such a ratio is not imposed as a limitation on the selection of a number of LED segments but only as a design choice. It should be appreciated that a lower number of segments provide a courser indication of signal strength of a tag, which is an indication of relative distance.

For ease of explanation, the instant example illustrates what may be shown to a viewer of a bar-graph display 21 when the display 21 is activated in a monotonic sequence (i.e., linearly increasing signal strength). The astute reader will recognize that, in a practical situation, the LED 21 shrinks and grows in accordance with the instantaneous changes in input signal strength.

Figure 9:
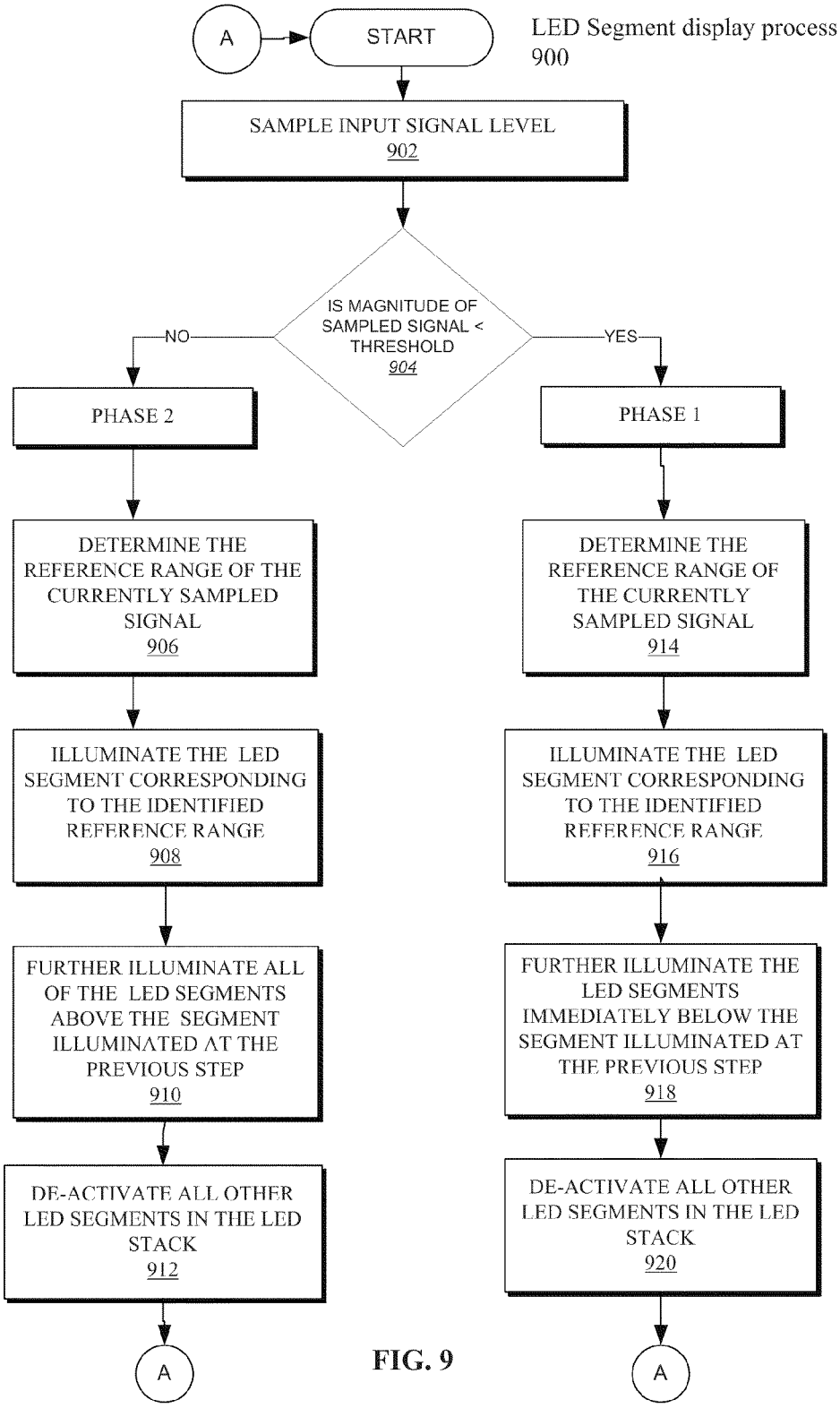
FIG. 9 is a flowchart of a display method according to an embodiment of the invention.

FIG. 9 Display Method Flowchart

FIG. 9 is a flowchart of a display method according to an embodiment of the invention.

The process begins at step 902 where analog input signal levels are sampled and converted by an A/D converter to digital signal levels. The input signal levels may be derived from a return RF signal supplied by one or more of the Radio frequency (RF) tag units 20, 20', 20" in response to a query signal by the locator device.

At step 904, a reference range of the sampled signal level is determined.

At step 906, the LED segments that correspond to the identified reference range are illuminated in the LED display.

At step 908, the LED segments that do not correspond to the identified range are unlit (de-activated).

It should be understood that steps 906 and 908 may be performed as a single step in a look-up table embodiment as illustrated in FIG. 5 and discussed above.

Upon completing step 908, the process then returns to step 902 to acquire the next sampled RSSI signal from CPU 508 in the embodiment of FIG. 5.

Other Embodiments

In one embodiment, the display can be used in conjunction with modules implemented in hardware and/or software such as a camera, a video camera module, a videophone, a speakerphone, a vibration device for providing a vibrational alert, a speaker for providing an audible alert. In an embodiment, the audible alert can be a continuous tone for each of the first and second phases, differing in frequency and/or volume. In another embodiment, a non-continuous tone is used to denote transitions within each of the first and second phases. In another embodiment, the tone can be a voice alert.

In various embodiments, the display can be a light-emitting diode (LED) display, a liquid crystal display (LCD) unit or an organic light-emitting diode (OLED) display unit.

In one embodiment, it is contemplated to reverse the display order described above. In particular, phase I signals (low signal strength) are displayed on the bar-graph display 21 by the LED segments continuing to appear to grow steadily upward as a single unit" towards the upper boundary of the LED display 21. The phase II (high signal strength) signals appear to move downward as a single unit or "wave-front" towards the lower boundary of the LED display 21.

In one embodiment, it is contemplated to utilize a so-called "wave-front" for a first range of signal level values and a conventional single segment display for a second range of signal level values.

In one embodiment, it is contemplated to exclusively utilize a moving wave-front, irrespective of the signal strength level. Varying levels of signal strength are determined exclusively from the direction and/or color and/or associated audible tone and/or speed of the wave-front. For example, a wave-front could be moving in a first direction for a first range of input signal levels and moving in a second, opposite direction, for a second (higher) range of input signal levels. In addition to the directional change, the wave-front can be blue in the first direction and red in the second direction, or have a first tone in the first direction and a second tone in the second direction or be moving at a certain rate of speed in a first direction and a different rate of speed in the second direction. Or combinations of the above, as will now be apparent to the reader.

In one embodiment, it is contemplated to change the color of the LEDS for any transitions between the first and second phase. For example, the LED segments could be displayed in green for phase I signals (low signal strength) and would change to red for phase II signals (high signal strength).

In one embodiment, it is contemplated to cause the LED segments to blink for one of the two phases.

In one embodiment, it is contemplated to use more than two phases (i.e., three or more phases). For example, in a three phase system, two discrete threshold levels are utilized. Within each of the three phases, the bar-graph display 21 can provide unique indicia, via the LED segments, to denote the particular phase, as described above. As one example, a three phase system can employ two threshold levels, Z1 and Z2, thereby characterizing an input signal as belonging to one of three phases, phase 1, from a zero signal level to Z1, phase 2, from the Z1 signal level to the Z2 signal level, and phase 3, from the Z2 signal level and above.

Figure 10:
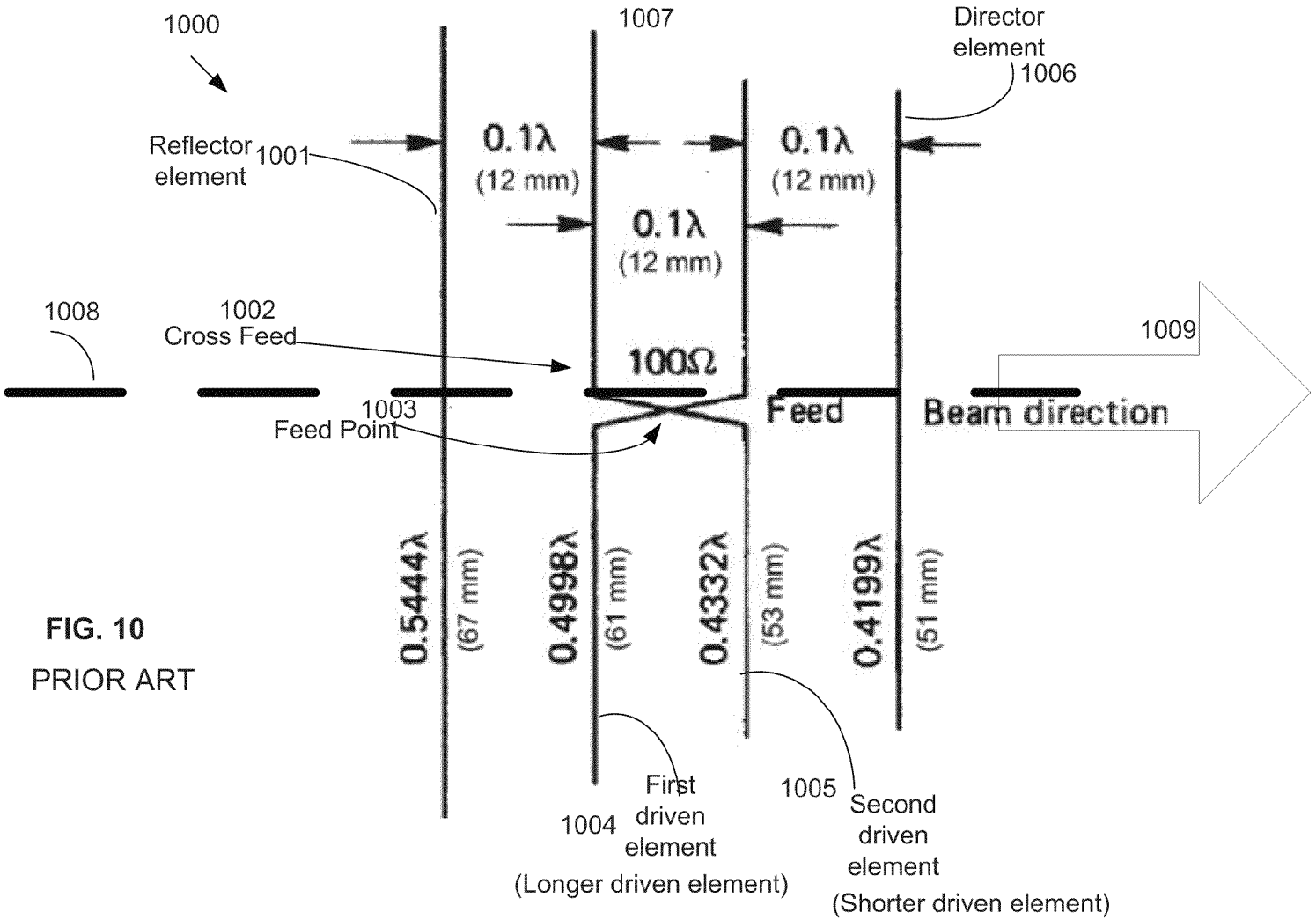
FIG. 10 PRIOR ART
FIG. 10 illustrates a conventional Yagi-Uda type antenna.

In one embodiment, it is contemplated to utilize a locator device including a bar-graph display 21 in conjunction with third party products, whereby the third party product becomes the primary user interface for providing an indication to a user of signal levels received from RF tag devices 33. Such third party devices may include, for example, a cell phone, a camera, a video camera module, a videophone, a speakerphone, a vibration device, a speaker, a microphone, a television transceiver, a hands free headset, a keyboard, a Bluetooth™ module, a frequency modulated (FM) radio unit, an external liquid crystal display (LCD) display unit, an external organic light-emitting diode (OLED) display unit, a digital music player, a media player, a video game player module, an Internet browser, and/or any wireless local area network (WLAN) module FIG. 10 Antenna FIG. 10 illustrates components of a conventional cross fed Yagi-Uda antenna. Yagi-Uda antennas are discussed in detail H. Yagi, "Beam Transmission of Ultra Short Waves," Proc. IRE, vol. 26, June 1928, pp. 715-741; T. Milligan, Modern Antenna Design, McGraw-Hill, New York, 1985, pp. 332-345; and J. D. Kraus, Antennas, $2^{nd}$ Edition, McGraw-Hill, New York, 1988, pp. 481-483, incorporated by reference herein by reference.

A conventional Yagi-Uda dipole antenna 1000 is an endfire antenna array typically employing co-planar dipole antenna elements 1001, 1004, 1005 and 1006. A typical Yagi-Uda dipole antenna has at least three dipole elements: a dipole reflector element 1001, at least one driven dipole element (feed element 1004, 1005) and a dipole director element 1006. Generally speaking, an actively driven element (the element 1004, 1005 connected to the transmission line) is also referred to as the feed element. The array 1000 further typically includes two or more parasitic elements, e.g., a reflector 1001 and one or more directors 1006.

The dipole antenna elements of a conventional Yagi-Uda array are positioned in spaced relationship along an antenna axis 1008. Generally, the driven dipole element (e.g., 1004, 1005) parasitically excites the other dipole elements to produce an endfire beam in the direction of arrow 1009. The transmission direction indicated by arrow 1009 is the direction in which electromagnetic energy propagates when the transceiver to which the antenna 1000 is coupled via feed point 1003 is operated in the transmit mode.

As seen from the dimensions illustrated in FIG. 10 the length of conventional Yagi-Uda elements and the distances between these elements are too great to permit the antenna to be disposed within the housing of a small handheld device such as locator device 400 (illustrated in FIG. 4). These relatively large dimensions determine the radiating power of the antenna system. Therefore, the dimensions of the typical antenna illustrated in FIG. 10, while providing sufficient radiating power, are too large for implementation in a small handheld device such as device 400. Unfortunately, reducing the element size, decreasing spacing, or scaling the conventional Yagi-Uda antenna 1000 illustrated in FIG. 10 to fit, for example, within a housing such as that shown for device 400, would result in unacceptable levels of excitation and interference between the driven elements of the antenna and the parasitic elements. The level of interference would be such that the resulting antenna would be prevented from operating to transmit and receive signals to and from a tag transmitter of radio frequency locator application such as the one described herein.

Figure 11:
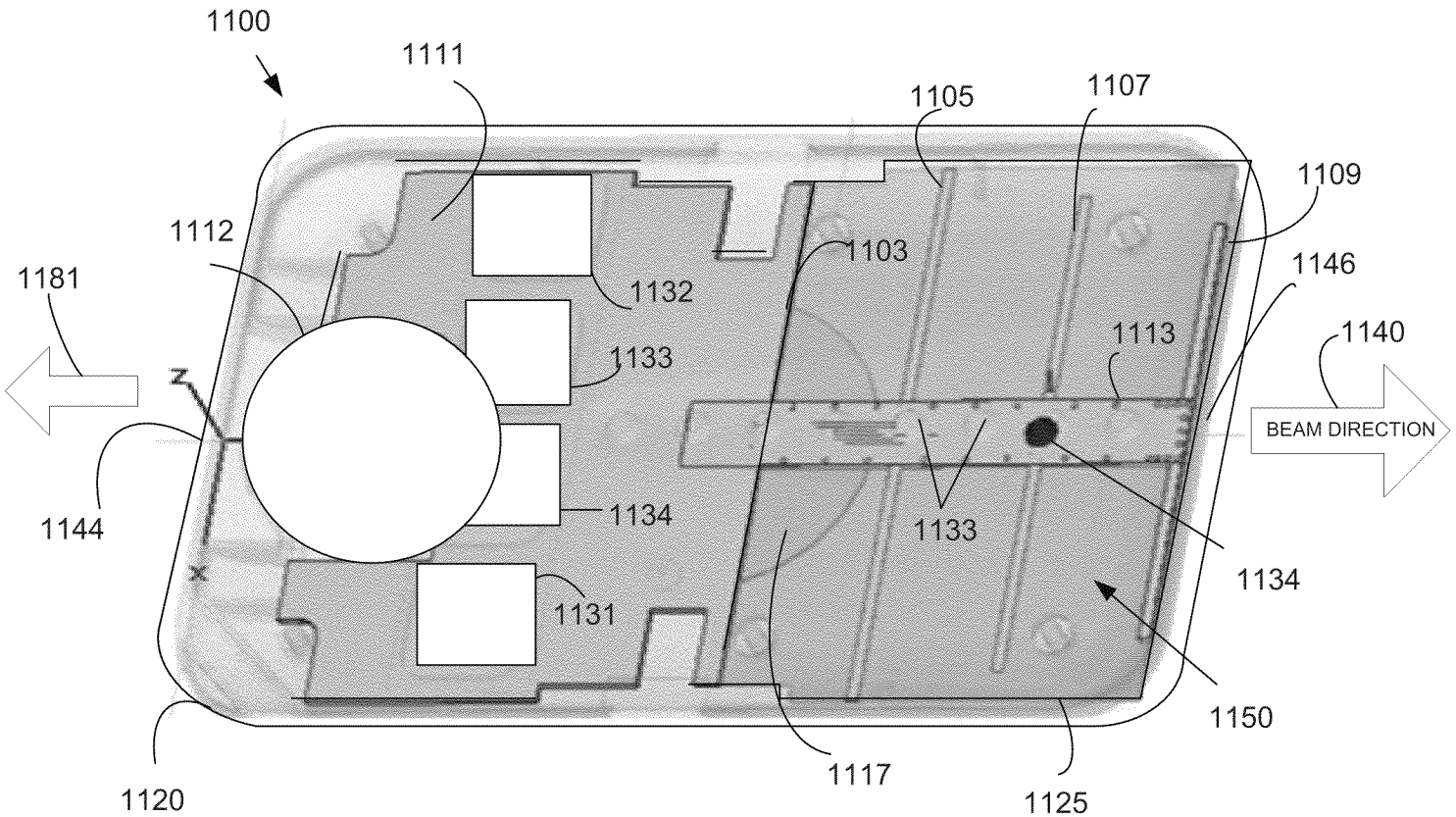
FIG. 11 is an illustration of a locating device according to an embodiment of the invention including an antenna portion according to an embodiment of the invention.

FIG. 11 Antenna and Housing

The inventors have recognized the need for an antenna having directional and operational characteristics such as those possessed by the Yagi-Uda antenna 1000 of FIG. 10, yet small enough to fit within a housing (for example a 2"×4"×¼" housing) such as that illustrated in FIG. 11 at 1120 (also illustrated in FIG. 4 at 415), while avoiding the interference and performance degradation naturally occurring should a Yagi-Uda type antenna be merely scaled to fit within the housing. FIG. 11 illustrates an antenna 1150 according to an embodiment of the invention. Antenna 1150 is implemented in a housing 1120 comprising a hand held Radio Frequency Identification (RFID) device. Antenna 1150 performs transmit and receive functions associated with larger conventional antennas such as antenna 1000 described in FIG. 10. However, the inventive features of antenna 1150 permit antenna 1150 to fit within a smaller footprint, for example, within a printed circuit board 1125 without suffering performance degradation that would be expected in such a small scale application. Antenna 1150 is supported by a substrate, for example in one embodiment of the invention antenna 1150 is implemented on a multi-layer printed circuit board 1125. Printed circuit board 1125 includes a ground plane 1111 and antenna 1150 comprises a plurality of dipole elements, for example, elements 1103, 1105, 1107, 1109 coupled to ground plane 1111.

According to one embodiment of the invention housing 1120 has a length L of about 4.5 inches, a width W of about 2.4 inches and a thickness T of about 0.48 inches.

The dipole elements are positioned in spaced relationship along an antenna longitudinal axis defining a spine 1113. Antenna 1150 comprises at least first, second and third dipole elements. In one embodiment of the invention a first dipole element comprises at least one driven dipole element. In the embodiment illustrated in FIG. 11 two driven dipole elements 1105, 1107 are employed.

An additional dipole element comprises a director element 1109. Another dipole element comprises a reflector dipole element 1103. In contrast with conventional Yagi Uda antennas, a reflector element 1103 of antenna 1150 comprises at least a portion of ground plane 1111. In further contrast with conventional Yagi Uda antennas, some embodiments of antenna 1150 comprise first and second driven dipole elements 1107 and 1105 respectively. According to some embodiments of the invention first and second driven dipole elements 1107 and 1105 comprise cross fed dipole elements. In some embodiments of the invention a feed point 1134 is coupled to spine 1113 to provide a drive signal to driven elements 1107 and 1105.

According to one embodiment of the invention PCB 1125 also supports a plurality of circuit components, for example, 1131, 1132, 1133 and 1134. Examples of suitable circuit components include Light Emitting Diodes (LEDs), Liquid Crystal Display (LCD) elements, communication circuits, RF chips, e.g. Zigbee components, microcontrollers and microprocessors, driver circuits and a variety of other possible circuit components. Circuit components 1131-1134 are operatively coupled between a source of power, for example a coin battery 1112, and ground plane 1111. In one embodiment of the invention PCB 1125 further supports an audible alarm component for example, a diaphragm 1117.

PCB 1125 is disposable within housing 1120 as illustrated in FIG. 11. According to one embodiment of the invention housing 1120 is formed of plastic and provides a compact device suitable for at least partially enclosing IEEE 802.15.4 compliant wireless transceiver tags. In the embodiment illustrated in FIG. 11, antenna 1150 is positioned in a first portion of PCB 1125 and measures approximately 37 mm in length.

Ground Tunnel Feature—Isolation

According to one embodiment of the invention a ground tunnel (not shown) is formed between two layers of PCB 1125 defining spine 1113 of antenna 1150. In one embodiment of the invention the ground tunnel advantageously accommodates display circuits, for example, LEDs 1133 arranged along spine 1113. Such an arrangement reduces the housing size of the hand-held device 1100. At the same time a ground tunnel defined by spine 1113 provides radio frequency interference isolation between parasitic elements of antenna 1150 and associated driven elements 1105 and 1107. Thus embodiments of the invention comprise a ground element disposed along spine 1113 of antenna 1150. Accordingly electronics circuits may be accommodated within the floor plan of PCB 1125 including antenna 1150 without inducing excessive radio frequency interference (RFI) and without significantly degrading performance of antenna 1150.

Some embodiments of the invention comprise a plurality of ancillary circuits, for example LEDs 1133 positioned along a longitudinal axis of a spine 1113 and coupled to the ground element (not visible) disposed between first and second layers of PCB 1125 comprising spine 1133. Such an arrangement is advantageous in that it avoids adverse impact on the performance of antenna 1150 while accommodating a greater density of elements within housing 1120. In one embodiment of the invention a ground element comprises wiring extending along a longitudinal axis of spine 1113 and arranged so as to lie predominately parallel to a longitudinal axis of spine 1113.

Some embodiments of the invention include a ground element comprising an elongate conductive ground strip disposed between first and second layers of PCB 1125 in a PCB portion defining spine 1113. While relatively narrow ground strips are advantageous to minimize deleterious effects on the performance of antenna 1150, embodiments of the invention enable a relatively wide ground strip to be deployed within spine 1113 of PCB 1125 without severe degradation of antenna performance. With respect to the available footprint of a particular PCB implementation, a ground strip in accordance with one embodiment of the invention occupies up to about 10-20% of the width of the footprint of PCB 1125 with a negligible effect on the performance of antenna 1150. Other embodiments of the invention utilize up to about 50-60% of the available strip width while incurring only a moderate reduction in gain, bandwidth and or efficiency of antenna 1150.

According to one embodiment of the invention the ground tunnel is formed as a coaxial screen of the cross-feed elements and stubs (only one stub 1146 is shown in FIG. 11) of antenna 1150. In one embodiment of the invention a tunnel is formed along spine 1113 by interconnecting two relatively wide strips of conductor in PCB 1125 at small intervals (for example intervals of less than about 1/10 wavelength). In one embodiment of the invention display elements, for example, light emitting diodes (LEDs) are positioned along an axis defined by the tunnel and spine 1113. Alternative embodiments of the invention include other circuit elements such as transceivers, micro-controllers or buttons positioned along the tunnel portion and spine of PCB 1125.

Ground Plane Comprising Reflecting Element

In one embodiment of the invention a reflector dipole element 1103 is entirely implemented on at least a portion of a ground plane 1111 formed on PCB 1125 implementing antenna 1150. This arrangement further accommodates circuits for ancillary devices in a constrained footprint of housing 1120.

Thus antennas according to embodiments of the invention enable configuring of supporting circuitry in a compact device housing 1120. In one embodiment of the invention ground plane 1111 is arranged to lie in the near field of antenna 1150. Ground plane 1111 is configured as illustrated in FIG. 11 to accommodate arrangement of electronic circuits, for example, diaphragm 1117 and other circuit components as discussed above. In that manner antennas configured in accordance with some embodiments of the invention, i.e., wherein a reflecting element entirely comprises at least a portion of a ground plane, further reduce the overall dimensions of the housing 1120 for antenna 1150.

Diaphragm

Some hand-held radio frequency devices employing antennas of the invention include a beeper for sounding an audible alarm when predetermined criteria are met. In one embodiment of the invention PCB 1125 is formed so as to at least partially circumscribe a diaphragm 1117 comprising an audible alarm component. In one example embodiment of the invention diaphragm 1117 comprises a piezo-electric diaphragm beeper. In that embodiment of the invention parasitic elements of antenna 1150 and the physical dimensions of reflector element 1103 of antenna 1150 are configured to accommodate diaphragm 1117 and ground plane 1111 in a near-field of antenna 1150.

Pattern Tuning Stubs

Embodiments of the invention comprise a plurality of tuning stubs (best illustrated in FIGS. 12A-C) affixed to at least one of driven dipole elements 1105, 1107 of antenna 1150. In one embodiment of the invention a tuning stub is affixed to the longer driven dipole element 1105 of antenna 1150. Tuning stubs are configured so as to counter the deleterious effects of dielectric loading on performance of antenna 1150. Tuning stubs further counter the effects of a non-linear reflector element having a constrained footprint. In that manner, embodiments of the invention comprise a method of manufacture that provides a device with improved tolerance of manufacturing variations and hand proximity effects.

Impedance Matching Stubs

According to some embodiments of the invention antenna 1150 further comprises an impedance matching transmission line section, or stub, in the RF energy feed path to at least one of driven dipole elements 1105, 1107. In one embodiment of the invention an impedance matching stub is attached to the feed point on the shorter driven element 1107 of antenna 1150.

In that case the impedance matching transmission line is configured to transform an inherently low (about 23 Ohm) characteristic impedance of antenna 1150 to a relatively higher (100 Ohm) characteristic impedance of its associated transceiver and its transmission line feed. Some embodiments of the invention employing two driven elements 1105 and 1107 are cross fed from the RF feed line 1134.

Due to the presence of more than one driven dipole element, antenna 1150 is subject to a problem not encountered in conventional Yagi-Uda antennas. Antenna designs employing more than one driven element, for example, Log Periodic Dipole Arrays (LPDAs) can experience an excess excitation of the longer driven elements. This phenomenon results in frequencies at which the bore-sight gain of the antenna is significantly reduced over narrow bands of frequencies within the desired transmission band of the antenna. Furthermore this elevated radiation in the back-lobe (illustrated at 1181) could result in deterioration in the antenna's front-to-back ratio. The deterioration produces artifacts typically occurring in the upper end of frequency band in a short truncated array. These artifacts are associated with tightly resonant poorly radiating modes.

Known techniques for limiting excessive excitation in conventional larger scale antenna designs with more than one driven element include the use of relatively short (typically less than ¼ wavelength) short-circuit terminated transmission line stubs connected to the longer antenna driven dipole element. The stub is provided to limit excitation of the driven elements.

While this technique may be useful to limit excitation in driven antenna elements the inventors of the present invention took an approach to this problem not found in conventional design. The arrangement illustrated in FIG. 11 including constrained footprint of the ground plane 1111 (as a reflector element) of antenna 1150 and the presence of the beeper diaphragm 1117 imposes physical limitations on antenna 1150 that cause an under excitation of the larger driven element of the design to occur at the lower end of the band.

To solve the problem of undesirable frequency response at the lower end of the band, embodiments of antenna 1150 comprise a short length (typically linear ¼ wavelength) transmission line (stub) with an open-circuit end termination to the longer driven dipole element. Alternative embodiments comprise a longer length (by ¼ a wavelength) transmission line. However, this alternative has drawbacks in that additional space may be occupied by the longer stub.

One embodiment of the invention comprises antenna elements configured symmetrically about a central longitudinal antenna axis. In these embodiments the introduction of such a stub could adversely impact the symmetry of the antenna, and thereby interfere with the symmetry of the antenna's radiation pattern. To overcome this problem embodiments of the invention comprise two similarly dimensioned short length open circuit transmission stubs positioned co-axially with line of symmetry of antenna 1150. One stub is attached to each opposing side of the line of central axis of symmetry and at equal distances from the central axis line of symmetry. This stub arrangement maintains the natural symmetry of antenna 1150, and thus advantageously maintains the symmetry of the antenna radiation pattern.

In one embodiment of the invention this symmetry was accomplished by positioning a first stub (the open-circuit stub) along the line of symmetry, and substituting two identical short-circuit stubs symmetrically positioned parallel to the axis of symmetry for the single short-circuit stub otherwise demanded. The arrangement is illustrated in the ASCII-art figures illustrated in FIGS. 14A-14C described in further detail below.

Broadside Coupled Stripline

A conventional approach to reduce loss in strip lines is to increase the overall thickness of the strip-line. However, antennas of the invention are configured for deployment in RFID applications where overall thickness is constrained. Further embodiments of the invention accommodate a range of manufacturing tolerances that would otherwise yield an unacceptably inefficient line. Therefore embodiments of the invention comprise a broadside coupled micro-strip line characterized by geometry illustrated in FIG. 14C.

The dissipative losses in broadside-coupled strip-line for a given total thickness of homogeneous dielectric was discovered to be minimum when the thickness of dielectric material between the conducting lines is twice the thickness of dielectric between either conducting line and the nearest ground plane. This condition was found to hold regardless of the width of tracks employed and whether or not the line is resonant (not terminated in its characteristic impedance).

Figure 14A:
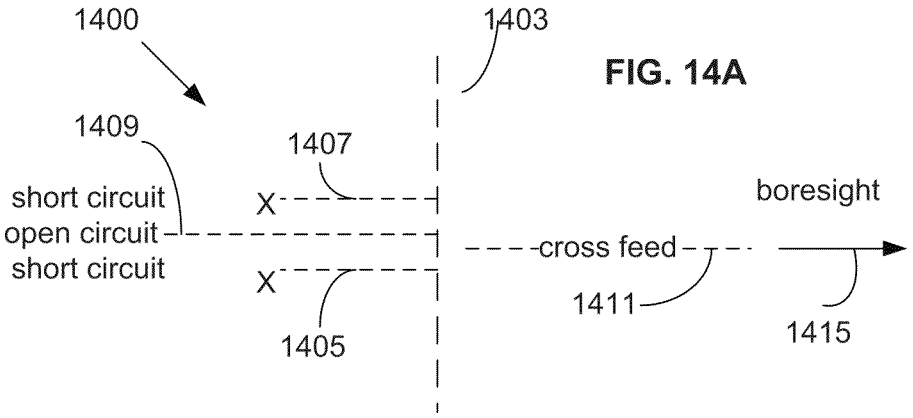
FIGS. 14A-14C are ASCII diagrams illustrating cross sections of antenna portions according to an embodiment of the invention.
Figure 14B:
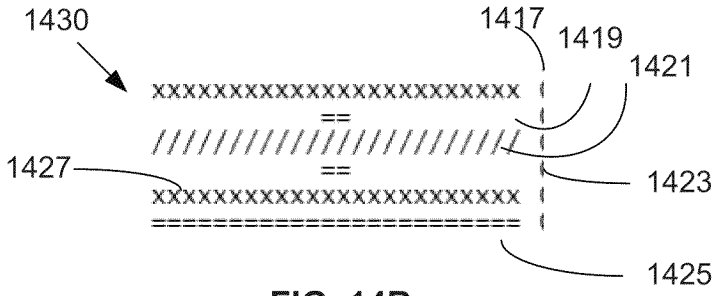
Figure 14C:
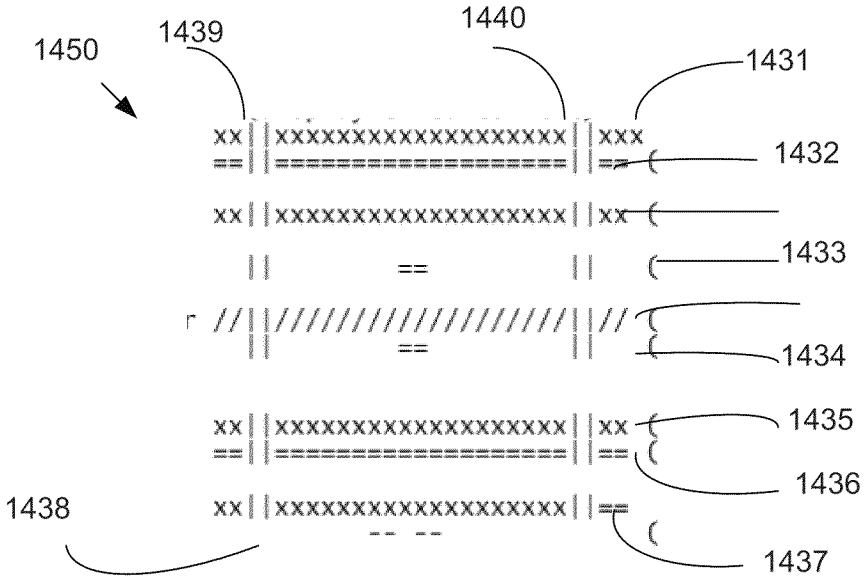

In other words, given a total dielectric thickness, 4 t, for a broadside coupled strip-line transmission line (with a cross-section as illustrated in FIG. 14C, the loss is minimum when the dielectric thickness is distributed such that the middle dielectric layer is 2 t thick and the two outer dielectric layers are each t inches thickness.

Some embodiments of the invention are configured in accordance with this geometry in the cross-feed between dipoles of the cross-feed of antenna 1150 to maximize its efficiency for a given total thickness.

Accordingly the invention provides a directional antenna 1150 implemented on a printed circuit board 1125 and configured for disposition in a small housing 1120. In one example embodiment the housing is about the size of a credit card, for example, about 86×54 mm. Thus antennas according to embodiments of the invention are advantageously configured for use in devices such as hand held RFID locator devices, for example, transceiver tags such as those described in IEEE 802.15.4.

FIGS. 12A-12D PCB

According to one embodiment of the invention PCB 1125 is formed to comprise a plurality of layers. For example, in one embodiment of the invention PCB comprises six layers. FIGS. 12A through 12D illustrate respective layers 2-5 of a multi-layered PCB such as PCB 1125 illustrated in FIG. 11 according to an embodiment of the invention. In one embodiment of the invention at least two elements of antenna 1150 (FIG. 11) are implemented in differing respective layers of PCB 1125. In one embodiment of the invention antenna 1125 is implemented in an upper region (for example, extending about 37 mm) of PCB 1125.

In that manner antennas according to the invention accommodate inherent losses and variations associated with manufacturing common copper on FR4 manufacturing materials are mitigated. Thus methods of manufacturing antennas are provided by the various embodiments of the invention which enable antennas characterized by reliable performance to be produced using a wider range of manufacturing processes and materials than would otherwise be possible.

Figure 12B:
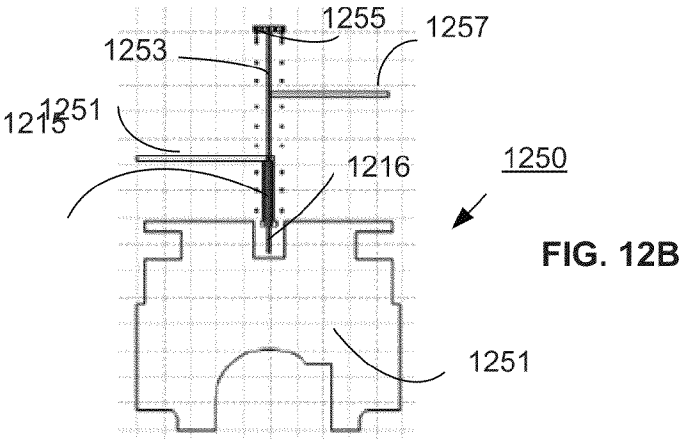
FIGS. 12A-12D illustrate antenna portions of an antenna according to an embodiment of the invention.
Figure 12D:
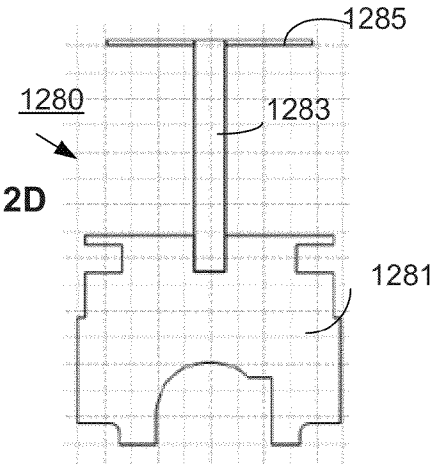
Figure 12A:
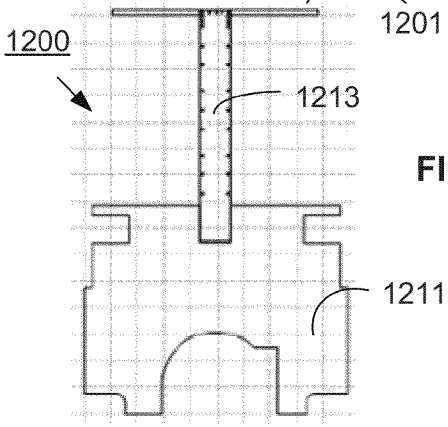

FIG. 12A is an illustration of an antenna portion implemented in a single layer 1200, for example a second layer of multilayer PCB 1125 according to an embodiment of the invention. Layer 1200 comprises director element 1201 coupled to spine 1213. Spine 13 is in turn coupled to ground plane 1211.

FIG. 12B illustrates a third layer 1250 of multilayer PCB 1125 according to a embodiment of the invention. Third layer 1250 comprises a terminating short circuit 1255 and an upper layer conductor 1253 of the matching stub described above. Third layer 1250 further comprises the second pole 1257 of first driven element, the first pole 1251 of second driven element, an upper layer conductor of open circuit stub 1216, a ground plane layer 1251 and an upper conductor 1215 of short circuit stubs. Further details of layer 1250 are discussed with respect to FIG. 13.

Figure 12C:
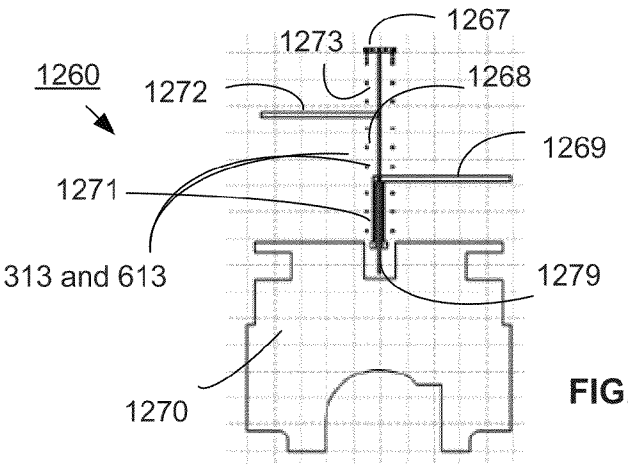

FIG. 12C illustrates a fourth layer 1260 of multilayer PCB 1125 according to an embodiment of the invention. Fourth layer 1260 comprises ground plane layer 1270, short circuit 1267, lower layer conductor 1273 of the matching stub, the first pole 1272 of the first driven element, the second pole 1269 of second driven element, lower layer 1279 of the open circuit stub, conductive through-hole vias 1268 (connecting spine portions of the ground planes, 1214 and 1285), lower conductor 1271 of short circuit stubs, and short circuit 1267.

FIG. 12D illustrates a fifth layer 1280 of multilayer PCB 1125 according to an embodiment of the invention. Fifth layer 1280 comprises ground plane layer 1281, spine 1283 and director element 1285.

Figure 13:
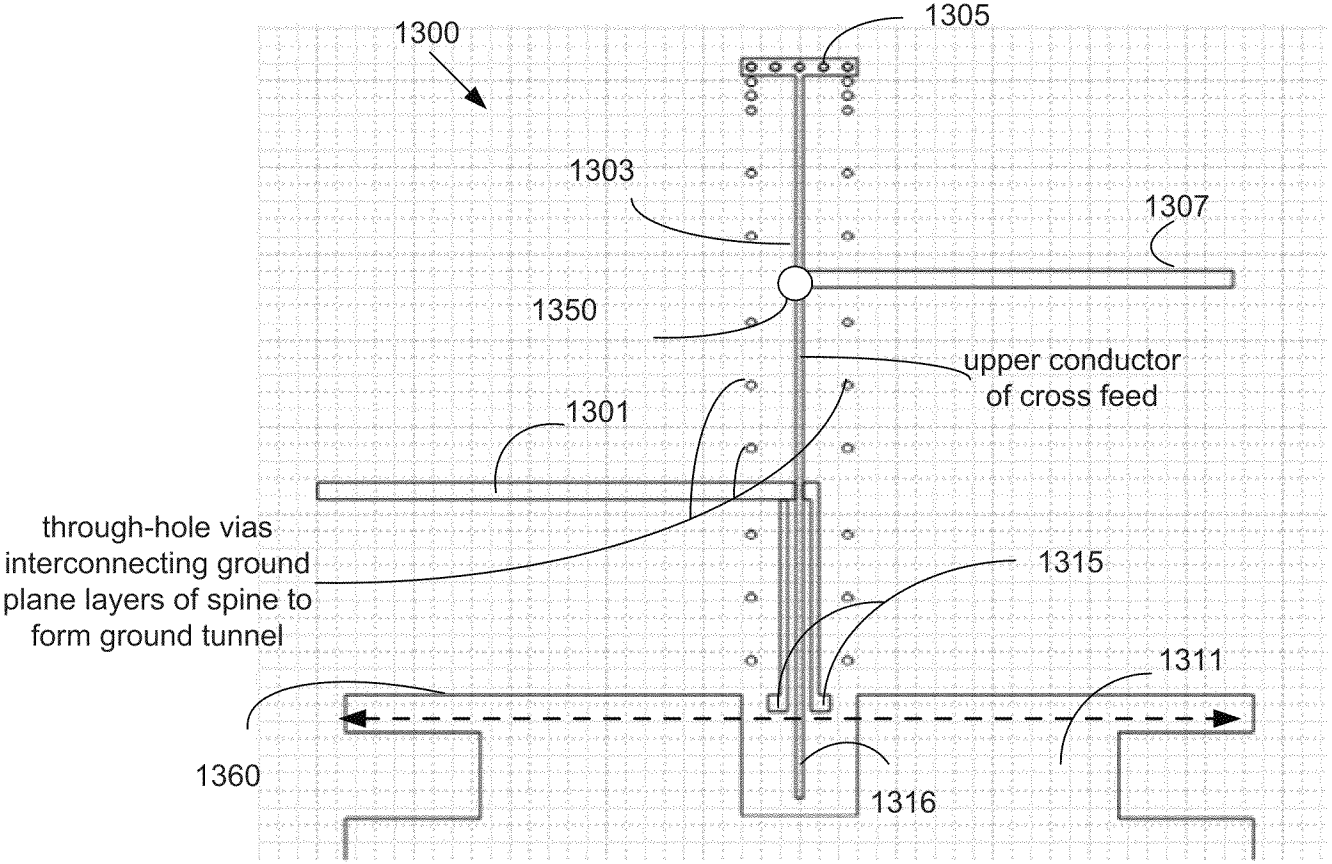
FIG. 13 is an illustration of an antenna portion according to an embodiment of the invention.

FIG. 13 PCB Layer 3

FIG. 13 illustrates layer 3 (also illustrated in FIG. 12B) in greater detail, showing the arrangement of stubs to the South (attached to the longer driven dipole element 1301) and to the North (attached to the shorter driven dipole element 1307). Layer 1305 illustrates ground plane 1311, an upper layer conductor 1316 of open circuit stub, upper layer 1315 of short circuit stubs, through-hole vias interconnecting ground plane layers of spine to for a ground tunnel, feed point 1350, first pole 1301 of second (longer) driven element, second pole 1307 of first (shorter) driven element, terminating short circuit stub 1305 short circuit stub 1303 and upper conductor of cross feed 1388.

FIGS. 14A-C Illustrate Cross Sections

FIG. 14A is an ASCII diagram illustrating a top view of PCB including pattern tuning stubs according to an embodiment of the invention.

FIG. 14B

FIG. 14B is a cross sectional view of PCB implementing a broadside coupled stripline providing a low loss antenna 1150 according to an embodiment if the invention. PCB comprises upper ground plane, upper dielectric, upper conductor layer, middle dielectric layer, upper conductor, lower dielectric and upper ground plane. In the embodiment illustrated in FIG. 14B, the relative dielectric thickness of upper dielectric layer, middle dielectric layer and lower dielectric layer is illustrated. In this embodiment the total thickness is 4 t.

FIG. 14C

FIG. 14C illustrates a cross section of a low loss broadside coupled stripline according to an embodiment of the invention. In the embodiment illustrated in FIG. 14C cross section is taken through vias of PCB. In this embodiment PCB has a total thickness of 4 t. The vias are placed at relatively short intervals to form a coaxial screen, or ground tunnel, by connecting upper and lower ground strips.

FIG. 15

Figure 15:
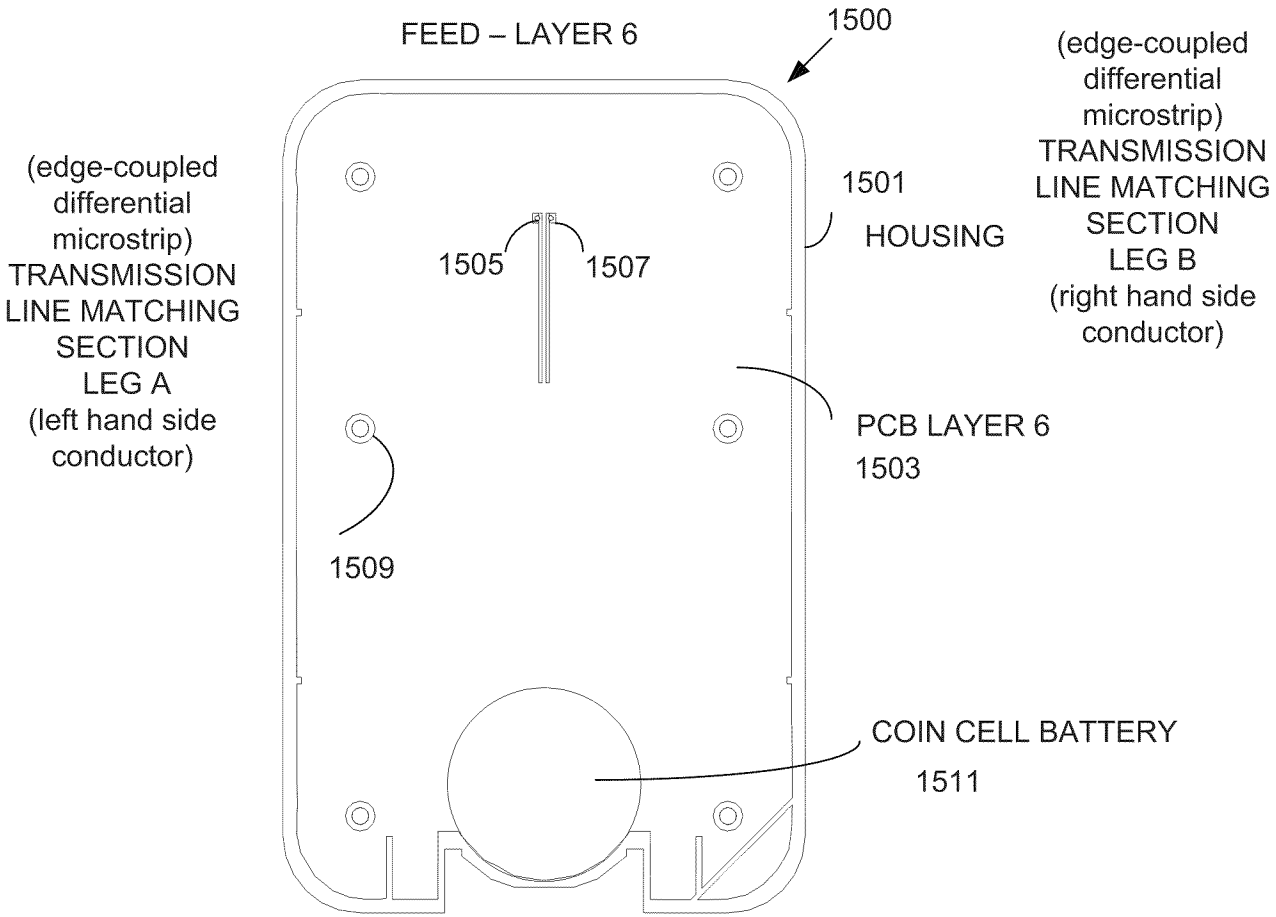
FIG. 15 is a graphical illustration of simulated performance of an antenna configured according to an embodiment of the invention.

FIG. 15 illustrates a sixth layer 1503 comprising a feed layer of the multilayer PCB illustrated in FIG. 11. Sixth layer 1500 includes an edge coupled differential micro-strip transmission line matching section (Leg A) 1505 (left hand conductor) and an edge coupled differential micro-strip transmission line matching section (Leg B) 1505 (right hand conductor).

FIG. 16

Figure 16:
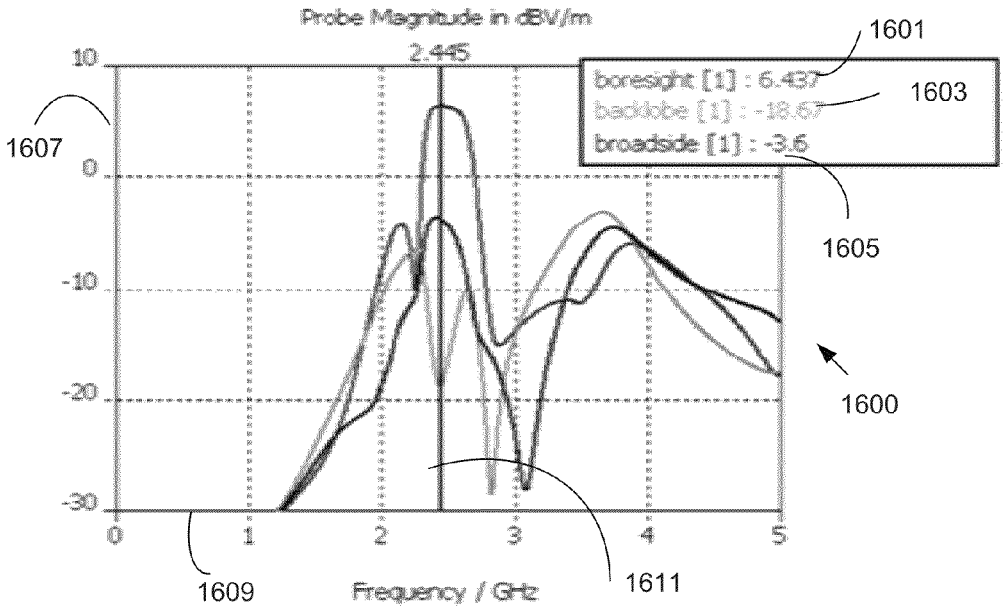
FIG. 16 is graphical representation of simulation results showing wideband gain performance of an antenna configured in accordance with an embodiment of the invention.

FIG. 16 presents a wideband view of a simulation result for the gain (dBi) of antenna 1150 (illustrated in FIG. 11) configured in accordance with embodiments of the invention described herein. FIG. 16 illustrates antenna performance in the forward direction (boresight), backward direction (backlobe), and vertically up or down (broadside).

Antennas according to some embodiments of the invention are characterized by nominal gains of at least about 6 dBi. Some embodiments of the invention are characterized by a directivity of about 7 dBi over approximately a 330 MHz (13%) for 1 dB gain bandwidth centered at 2445 Mhz. Further embodiments of the invention are characterized by a front to back ratio of 25 dB. These embodiments correspond to an operation frequency in about the middle of the Industrial Scientific Medical (ISM). Such embodiments are particularly advantageous for devices such as hand held RF identification devices and components.

FIG. 17

Figure 17:
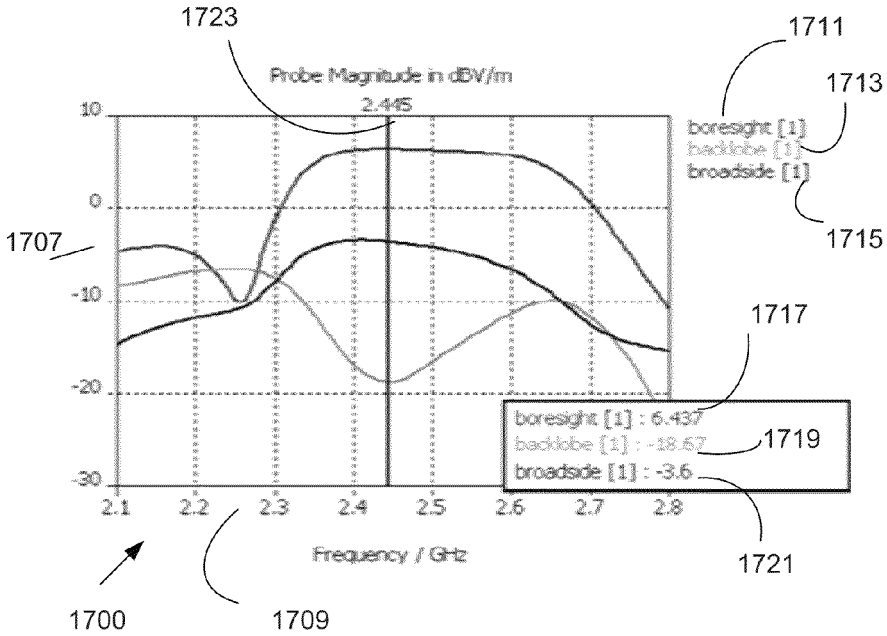
FIG. 17 is an illustration of an antenna portion according to an embodiment of the invention.

As illustrated in FIG. 17 an antenna 1150 configured in accordance with some embodiments of the invention described herein nominally yields a gain of 6 dBi with a directivity of 7 dBi over a 330 MHz (13%) for 1 dB gain bandwidth centered at 2445 Mhz, and a front to back ratio of 25 dB (the operation frequency of a locator device in the middle of the ISM band). Performance is stable for typical variations in material properties and manufacturing tolerances to be expected in production, and tolerates hand held operation.

The performance of antenna 1150 configured in accordance with embodiments of the invention described herein exceeds that of a conventional Yagi design of the same size. The gain is nominally 6 dBi and a directivity of 7 dBi over a 330 MHz (13%) for 1 dB gain bandwidth centered at 2445 Mhz. The front to back ratio is typically 25 dB at an operation frequency corresponding to the middle of the ISM band. The performance of antenna 1150 configured in accordance with embodiments of the invention described herein is stable for typical variations in material properties and manufacturing tolerances to be expected in production, and tolerates hand held operation.

FIG. 18

Figure 18:
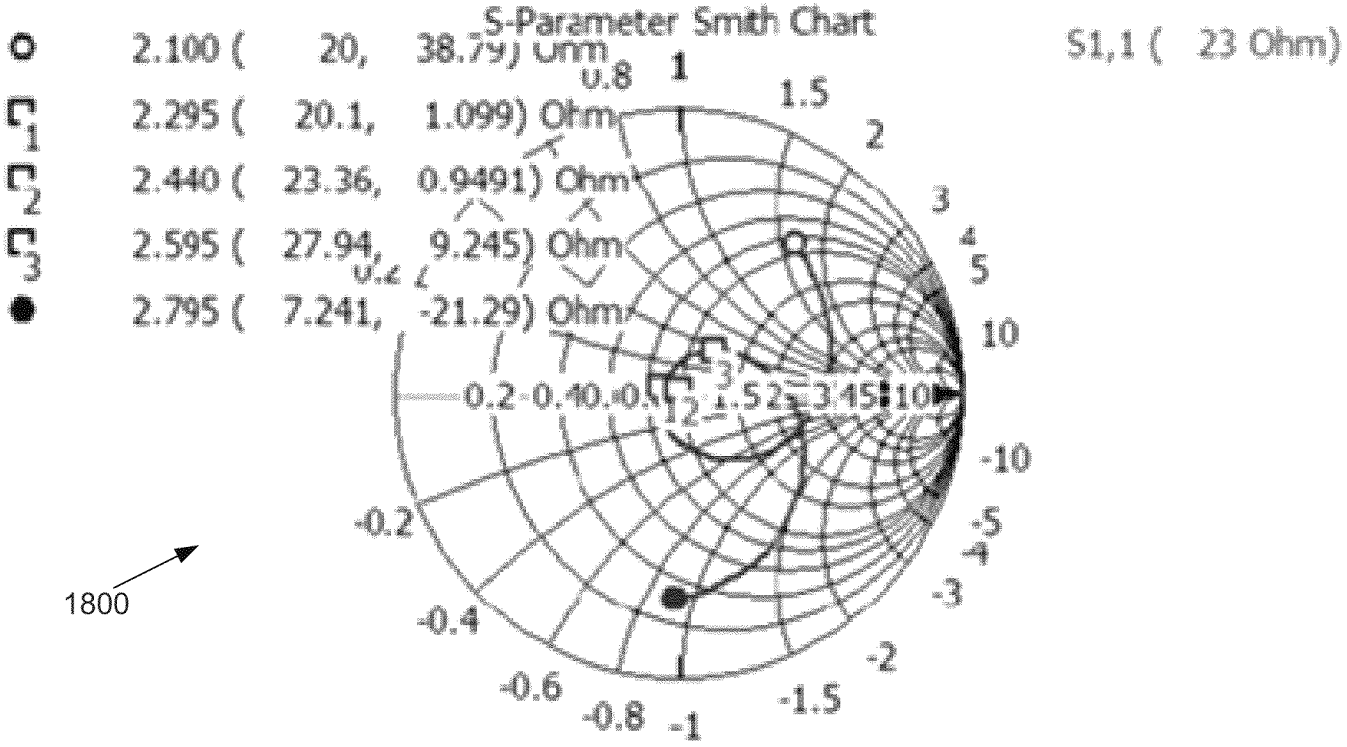
FIG. 18 is an S parameter Smith chart graphically illustrating simulation results of an antenna configured according to an embodiment of the invention.

FIG. 18 provides an S parameter Smith chart graphically illustrating gain (dBi) of antenna 1150, for example illustrated in FIG. 11 configured in accordance with embodiments of the invention described herein. FIG. 18 shows the antenna performance in the forward direction (boresight), backward direction (backlobe), and vertically up or down (broadside) directions.

Figure 21:
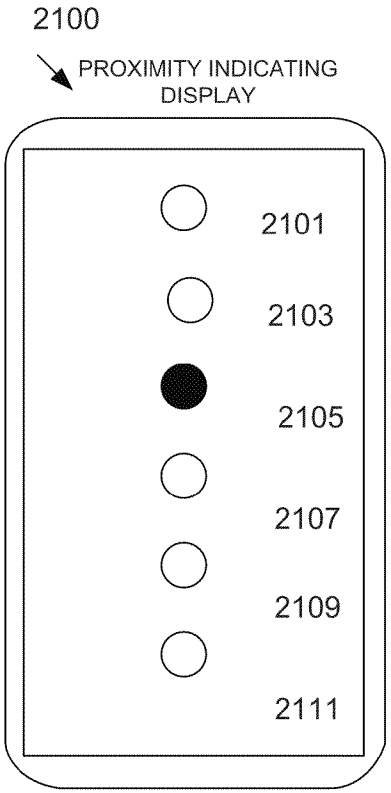
FIGS. 19-21 illustrate embodiments of an example hand held cellular telephone device including a locator device employing an antenna configured according to an embodiment of the invention.
Figure 20:
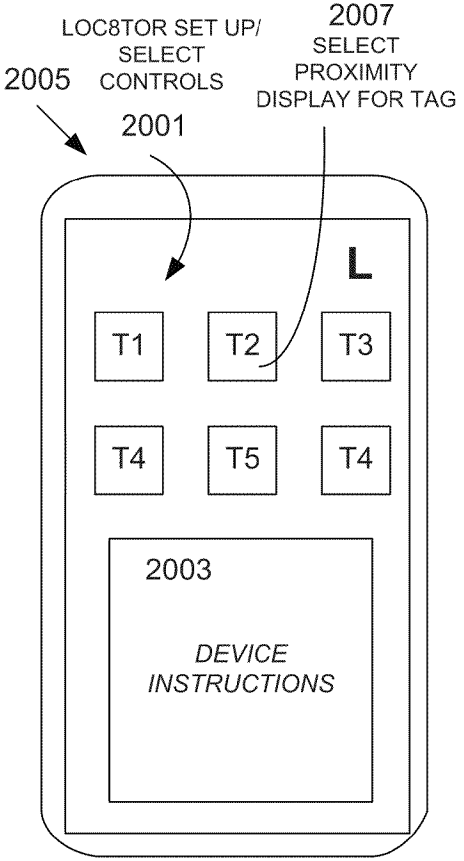
Figure 19:
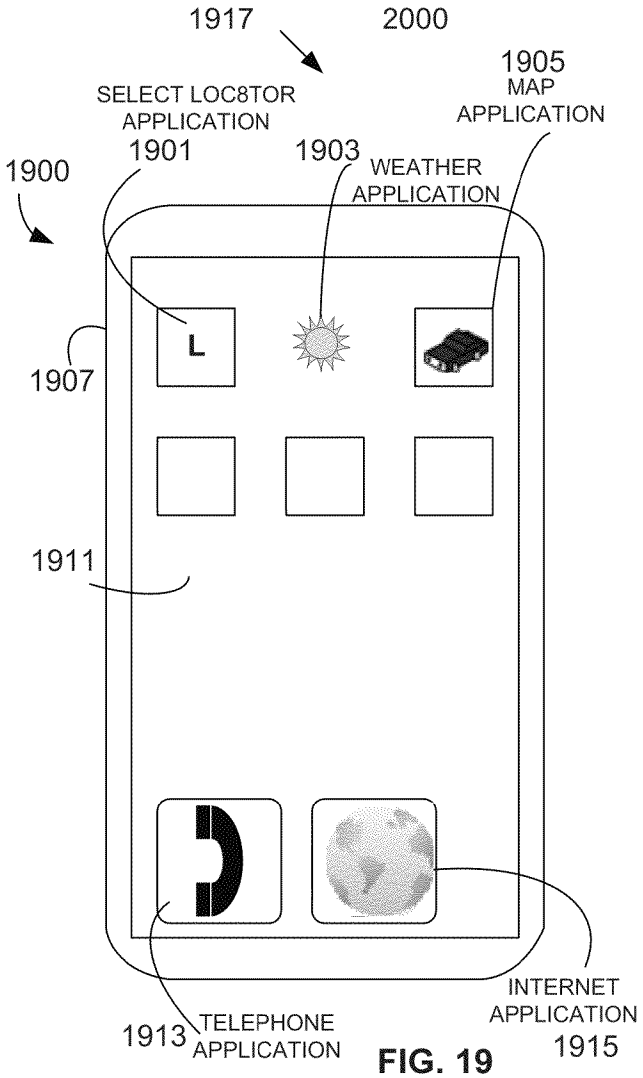

FIGS. 19-21 Slim Cell Phone and RF Device Applications

FIG. 19 illustrates an embodiment of a cellular telephone device 1917 embodying locator device according to an embodiment if the invention. Device 1917 comprises a display portion 1911 comprising a touch screen. In one embodiment of the invention, a touch area 1901 activates a locator application. Upon activation of the locator application a graphical user interface 2001 (example illustrated in FIG. 20) is displayed on the touch screen. By touching a graphical tag representation, for example area T2 for tag 2 a graphical display of a signal strength indicator similar to the LED indicator described in the display section of this specification is displayed to the user. Operation of the device 1917 then proceeds as described with respect to the display device illustrated, for example, in FIGS. 3 and 4.

FIGS. 20-21 illustrates devices, at least partially enclosed in compact, hand-held casings such as housing 1900 and enclosing circuits implementing a plurality of features, or 'applications' including a locating application according to an embodiment of the invention. Example selectable applications include telephone application 1913, Internet-based application 1915, map application 1905, weather application 1903, and locating application 1901.

FIG. 20 illustrates the user interface 1911 (of FIG. 19) as it appears upon user selection of locating application 1901 on touchscreen display 1911 of FIG. 19. A plurality of tag icons T1-T5 represent tags attached to items to be located. In one embodiment of the invention, instructions for operation of the locating application are provided in a device instruction portion 2003 of touchscreen display 1911. Upon user touching a tag icon, device 1900 initiates locating operations for the tag corresponding to the touched icon. Locating operations are carried out via radio frequency communication between device 2100 and the corresponding tag. In one embodiment of the invention, various embodiments of the antenna described herein, for example, with respect to FIG. 4, are housed within device 2100 and deployed to transmit and receive the radio frequency communication for locating a tag.

FIG. 21 illustrates a device 2100 including display indicators 2101, 2103, 2105, 2107. 2109 and 2111 according to an embodiment of the invention. In the example illustrated in FIG. 21 indicator 2105 is illuminated in response to user selection of tag icon T2 (illustrated in FIG. 20). The illumination pattern illustrated in FIG. 21 corresponds to a specific relative separation of the tag associated with tag icon T2 from device 2100 at the time the user selects the tag icon.

Figure 22:
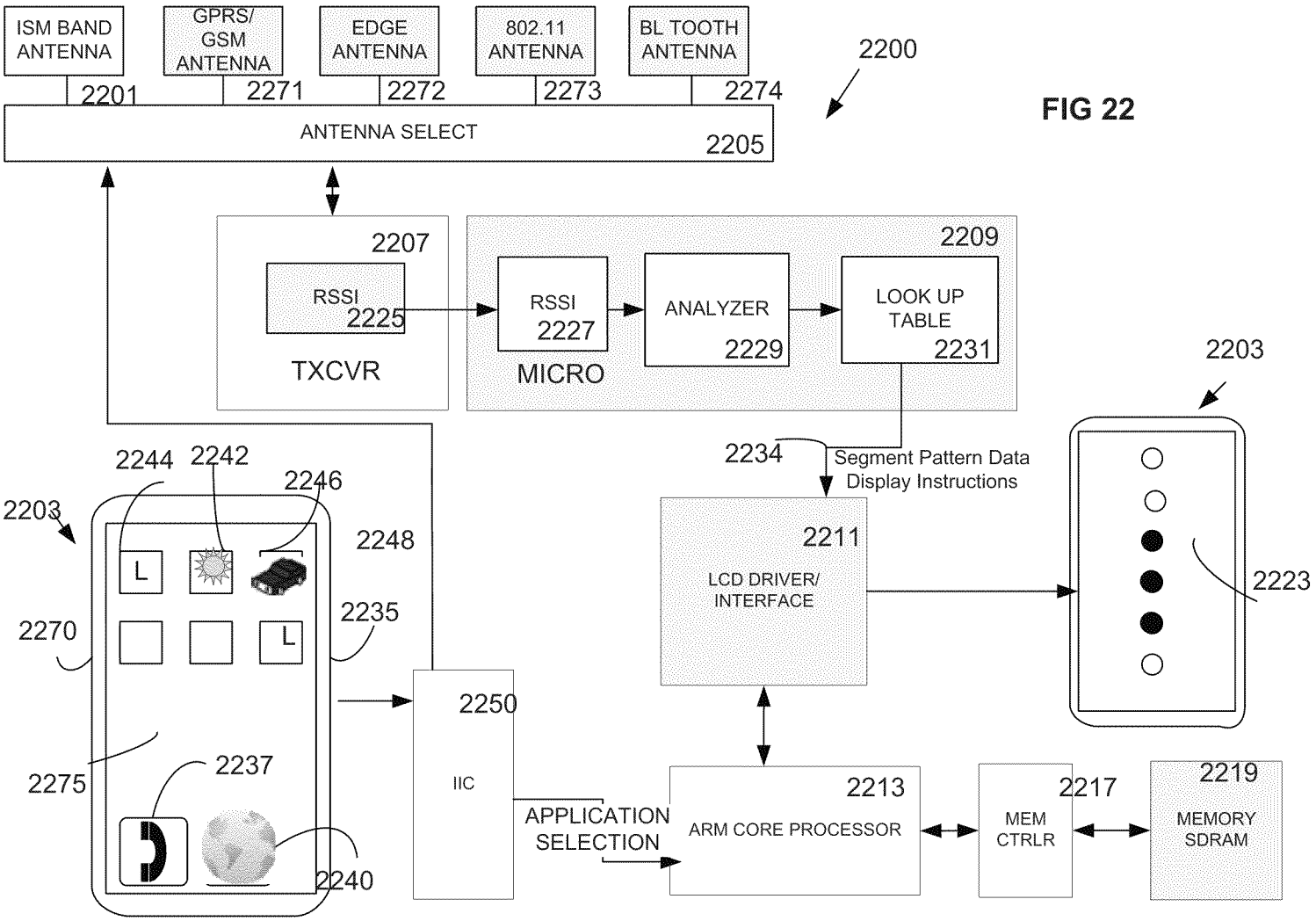
FIG. 22 is a block diagram of an example hand held mobile device including a user selectable locating feature employing an antenna according to one embodiment of the invention.

FIG. 22 is a block diagram of the device 2203 similar to the device illustrated in FIGS. 20 and 21, and including example communication circuits such as transceiver 2207. The communication circuits are enclosed in a housing 2270 and configured to implement user selectable applications provided by device 2203.

Transceiver 2207 communicates with antenna select circuit 2205 to select an antenna, e.g., one of antennas 2201, 2271, 2272, 2273 or 2274 to implement appropriate radio frequency communication for a selected application. In one embodiment, an antenna according to an embodiment of the present invention implements at least one of the selectable antennas, e.g., ISM band antenna 2201. Accordingly, a device according to one embodiment of the invention comprises the antenna described in FIGS. 11-15 enclosed in a housing such as 2270 and coupled to communications circuits to implement an application for device 2203. In one embodiment of the invention, at least one communications circuit is electrically coupled to the antenna ground plane (e.g. ground plane 1111 illustrated in FIG. 11).

Other example circuits implementing a locating application deploying an antenna according to an embodiment of the invention include an interface controller 2235, processor 2213, memory controller 2217 and memory 2219. For embodiments of the invention employing a display device described herein (see, e.g., FIGS. 5-9), a processor 2209 is coupled to transceiver 2207 to receive an indication of received signal strength for a selected tag. An analyzer is evaluates the received signal strength indication and provides a vector to lookup table 2231. Table 2231 provides the corresponding indicator segment pattern display instructions to LCD driver interface 2211 as described in greater detail with respect to FIG. 5.

One example of a device housing 2270 suitable for enclosing an antenna according to various embodiments of the invention is the Apple™ iPhone™. One embodiment of an antenna of the invention is configured for coupling to communication circuits of a device such as device 2203, and enclosable in a housing, e.g., housing 2270 of FIG. 22. In one example embodiment of the invention an antenna of the invention has dimensions of approximately 4.5×2.4×0.46 inches (115×61×11.6 mm), i.e., 115 mm (Length)×61 mm (Width)×11.6 mm (Thickness).

While the invention has been shown and described with respect to particular embodiments, it is not thus limited. Numerous modifications, changes and enhancements will now be apparent to the reader.

What is claimed is:

1. An antenna comprising: a multilayered substrate including:

a first layer disposed on an outer face of the multilayered substrate comprising a base portion and a spine portion extending from the base portion along a central axis of said multilayered substrate;

a second layer disposed directly above or below said first layer configured as a first ground plane, the second layer comprising a base portion and a spine portion extending from the base portion along a central axis of said multilayered substrate;

a third layer disposed directly above or below said second layer, the third layer comprising a first pole of a first driven element and a second pole of a second driven element disposed on a portion of said third layer and coupled to a first spine portion to form opposing poles of a first and a second antenna dipole;

a fourth layer disposed directly above or below said third layer, the fourth layer comprising a second pole of a first driven element and a first pole of a second driven element disposed on a portion of said fourth layer and coupled to a second spine portion to form opposing poles of a first and second antenna dipole counterbalancing those on the third layer;

a fifth layer disposed directly above or below said forth layer, the fifth layer configured as a second ground plane, wherein the second ground plane further comprises a base portion and a spine portion extending from the base portion along a central axis of said multilayered substrate;

wherein said second and fifth layers are electrically coupled ground planes.

2. The antenna of claim 1 wherein said substrate includes at least one communication circuit operatively coupled to a power source and to said electrically coupled ground planes, said communication circuit further coupled to said directional antenna such that said substrate implements a radio frequency locating device including said antenna.

3. The antenna of claim 2 wherein said substrate further includes at least one display device coupled for operation between said power source and said electrically coupled ground planes, said display device further coupled to said communication circuit to receive information about signals received by said communication circuit via said antenna, said display device configured to display said information to an observer of said display.

4. The antenna of claim 2 further comprising: an upper ground strip supported by a first portion of said-substrate; a lower ground strip supported by a second portion of said substrate; said first and second substrate portions superimposed so as to form a cavity ground tunnel defined by said upper and a lower ground strips, said antenna disposable within a hand held housing to transmit and receive radio frequency signals.

5. The antenna of claim 1 wherein said printed circuit board includes at least one ancillary circuit device electrically coupled between a source of DC power and said electrically coupled ground planes, said antenna operable in conjunction with said ancillary circuit device within said housing to transmit and receive radio frequency signals.

6. The antenna of claim 1 wherein said first dipole comprises first and second driven elements configured for cross feeding with respect to a source of radio frequency energy.

7. The antenna of claim 1 further comprising a conductive strip disposed axially along at least a portion of said spine, said at least one ancillary circuit coupled to said electrically coupled ground planes via said conductive strip.

8. The antenna of claim 1 further comprising an open circuit stub positioned at a proximal (RF feed) end of said spine.

9. The antenna of claim 1 further comprising a short circuit stub positioned at a distal end of said spine.

10. The antenna of claim 1 wherein at least a portion of said first dipole is disposed on a first layer of said printed circuit board and at least a second portion of said second dipole is disposed on a second layer of said printed circuit board.

11. The antenna of claim 1, wherein the first layer further comprises one or more components.

12. The antenna of claim 11, wherein the components comprise one or more of: an antenna feeding signal circuit, a radio transceiver circuit, a microprocessor, a display device, a sensor.

13. The antenna of claim 1, further comprising a sixth layer disposed on an outer face of said multilayered substrate opposing said first layer.

14. The antenna of claim 13, wherein the sixth layer further comprises one or more components.

15. The antenna of claim 14, wherein the components comprise one or more of: an antenna feeding signal circuit, a radio transceiver circuit, a microprocessor, a display device, a sensor.

* * * * *